US006607259B2

(12) United States Patent
Mott et al.

(10) Patent No.: US 6,607,259 B2
(45) Date of Patent: Aug. 19, 2003

(54) THERMAL INKJET PRINTER HAVING ENHANCED HEAT REMOVAL CAPABILITY AND METHOD OF ASSEMBLING THE PRINTER

(75) Inventors: James A Mott, San Diego, CA (US); Blair Butler, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 118 days.

(21) Appl. No.: 09/975,781

(22) Filed: Oct. 11, 2001

(65) Prior Publication Data

US 2003/0071865 A1 Apr. 17, 2003

(51) Int. Cl.[7] ..... B41J 29/377
(52) U.S. Cl. ..... 347/18
(58) Field of Search ..... 347/18, 19, 85, 347/86, 87, 17, 23, 63, 6, 7; 219/544; 392/451

(56) References Cited

U.S. PATENT DOCUMENTS

| | | | | |
|---|---|---|---|---|
| 4,500,895 | A | | 2/1985 | Buck et al. |
| 4,771,295 | A | | 9/1988 | Baker et al. |
| 4,794,409 | A | | 12/1988 | Cowger et al. |
| 4,899,180 | A | | 2/1990 | Elhatem et al. |
| 4,994,826 | A | | 2/1991 | Tellier |
| 5,272,491 | A | * | 12/1993 | Asakawa et al. |
| 5,278,584 | A | | 1/1994 | Keefe et al. |
| 6,007,176 | A | * | 12/1999 | Askren et al. |
| 6,065,823 | A | * | 5/2000 | Kawamura |
| 6,120,139 | A | | 9/2000 | Childers et al. |
| 6,193,349 | B1 | | 2/2001 | Cornell et al. |
| 6,247,779 | B1 | | 6/2001 | Nowell, Jr. et al. |
| 6,254,214 | B1 | | 7/2001 | Murthy et al. |
| 6,273,555 | B1 | | 8/2001 | Hess |
| 6,280,013 | B1 | * | 8/2001 | Wade et al. |

FOREIGN PATENT DOCUMENTS

| | | | |
|---|---|---|---|
| JP | 05146658 | * | 6/1993 |
| JP | 09011469 | * | 1/1997 |

* cited by examiner

*Primary Examiner*—Raquel Yvette Gordon
*Assistant Examiner*—Charles W. Stewart, Jr.
(74) *Attorney, Agent, or Firm*—Walter S. Stevens

(57) ABSTRACT

A thermal ink jet printer having enhanced heat removal capability and method of assembling the printer. The thermal inkjet printer includes a thermal inkjet print bead adapted to hold an ink body therein. A heating element is adapted to be in fluid communication with the ink body for generating heat to heat the ink body. A vapor bubble forms in the ink body to eject an ink drop when the heating element causes the ink body to reach a predetermined temperature. Presence of the vapor bubble forces on ink drop out the printer to form an image on a recording medium. A conductive heat removal structure is in thermal communication with the heating element and is also in fluid communication with the ink body. Heat generated by the heating element is transferred from the heating element and into the heat removal structure. The heat removal structure then surrenders the heat to the ink body, which functions as an "infinite" heat sink. In this manner, the heat removal structure provides enhanced heat removal of heat generated by the heating element.

50 Claims, 22 Drawing Sheets

THERMAL INKJET PRINTER HAVING ENHANCED HEAT REMOVAL CAPABILITY AND METHOD OF ASSEMBLING THE PRINTER

BACKGROUND OF THE INVENTION

This invention generally relates to printer apparatus and methods and more particularly relates to a thermal ink jet printer having enhanced heat removal capability and method of assembling the printer, the printer being adapted for high speed printing and increased thermal resistor lifetime.

An ink jet printer produces images on a recording medium by ejecting ink droplets onto the recording medium in an image-wise fashion. The advantages of non-impact, low-noise, low energy use, and low cost operation in addition to the ability of the printer to print on plain paper are largely responsible for the wide acceptance of ink jet printers in the marketplace.

In the case of thermal inkjet printers, a print head structure comprises a single or plurality of ink cartridges each having a nozzle plate that includes a plurality of nozzles. Each nozzle is in communication with a corresponding ink ejection chamber formed in the print head cartridge. Each ink ejection chamber in the cartridge receives ink from an ink supply reservoir containing, for example, yellow, magenta, cyan or black ink. In this regard, the ink supply reservoir may be internal to the cartridge and thus define an "on board" or internal ink reservoir. Alternatively, each cartridge may be fed by conduit from an "off-axis" or remote ink supply reservoir. In either event, each ink ejection chamber is formed opposite its respective nozzle so ink can collect between the ink ejection chamber and the nozzle. Also, a resistive heater is disposed in each ink ejection chamber and is connected to a controller, which selectively supplies sequential electrical pulses to the heaters for actuating the heaters. When the controller supplies the electrical pulses to the heater, the heater heats a portion of the ink adjacent the heater, so that the portion of the ink adjacent the heater vaporizes and forms a vapor bubble. Formation of the vapor bubble pressurizes the ink in the ink ejection chamber, so that an ink drop ejects out the nozzle to produce a mark on a recording medium positioned opposite the nozzle.

During printing, the print head is moved across the width of the recording medium as the controller selectively fires individual ones of the ink ejection chambers in order to print a swath of information on the recording medium. After printing the swath of information, the printer advances the recording medium the width of the swath and prints another swath of information in the manner mentioned hereinabove. This process is repeated until the desired image is printed on the recording medium. Such thermal inkjet printers are well-known and are discussed, for example, in U.S. Pat. No. 4,500,895 to Buck, et al.; U.S. Pat. No. 4,794,409 to Cowger, et al.; U.S. Pat. No. 4,771,295 to Baker, et al.; U.S. Pat. No. 5,278,584 to Keefe, et al.; and the Hewlett-Packard Journal, Vol. 39, No. 4 (August 1988), the disclosures of which are all hereby incorporated by reference.

In addition, in order to increase print resolution, current practice is to place the nozzles and respective heaters relatively close together on the print head. Moreover, in order to increase printer speed, width of the printing swath is increased by including a relatively large number of nozzles and corresponding heaters in the print head. To further aid in increasing printer speed, the heaters are typically fired at a relatively high frequency.

However, it has been observed that such efforts to increase print resolution and printer speed may result in excessive heat generation in the print head. Excessive heat generation in the print head is undesirable. In this regard, bubble formation in the thermal inkjet print head is directly influenced by temperature and excessive heat generation interferes with proper bubble formation (e.g., size of vapor bubble). Also, excessive heat generation may cause the ink drop to be prematurely ejected. Premature ejection of the ink drop may in turn lead to printing anomalies (e.g., unintended ink marks) appearing on the recording medium. In addition, excessive heat generation may cause unintended vapor bubbles to accumulate in the ink, thereby blocking the exit nozzle and interfering with ejection of the ink drop when required. Further, excessive heat generation may ultimately shorten operational lifetime of the heater.

Techniques for cooling thermal inkjet print heads to reduce excessive heat generation are known. One such technique is disclosed by U.S. Pat. No. 6,120,139 titled "Ink Flow Design To Provide Increased Heat Removal From An Inkjet Printhead And To Provide For Air Accumulation" issued Sep. 19, 2000 in the name of Winthrop Childers, et al. and assigned to the assignee of the present invention. The Childers, et al. patent discloses an inkjet printer having a print head assembly that includes a substrate. Formed on the substrate are ink ejection chambers and their respective ink ejection heater resistors. Flow directors direct ink flow onto the substrate and heat transfers from the substrate into the ink as the ink flows toward the drop ejection chambers where the warm ink is ejected onto recording media. In this manner, the flow directors help channel the ink flow path to maximize heat transfer to the ejected ink droplets. Thus, it would appear the ejected ink droplet acts as a heat sink for removing heat from the substrate and hence from the print head assembly. However, the ink droplet itself has limited capacity or capability to act as a heat sink because the volume of the ink droplet is necessarily limited. Although the Childers, et al. device performs its function as intended, it is nonetheless desirable to enhance heat removal beyond the heat removal capability afforded by the limited volume of the ejected ink droplet. Thus, enhancing heat removal in the Childers, et al. device would increase printer speed and heater lifetime.

Therefore, what is needed is a thermal ink jet printer having enhanced heat removal capability and method of assembling the printer, the printer being adapted for high speed printing and increased thermal resistor lifetime.

SUMMARY OF THE INVENTION

The present invention resides in a thermal inkjet printer having enhanced heat removal capability, comprising a thermal inkjet print head adapted to hold an ink body, the print head including a heating element adapted to be in fluid communication with the ink body; a heat removal structure in thermal communication with the heating element for transferring heat from the heating element to the ink body; and a controller coupled to the heating element.

According to an aspect of the present invention, a thermal inkjet printer includes a thermal inkjet print head adapted to hold an ink body therein. The print head comprises an ink cartridge including a heat conductive substrate and a resistive heating element coupled to the substrate. The cartridge also includes a face plate having a nozzle orifice positioned opposite the heating element. The heating element is adapted to be in fluid communication with the ink body for generating heat to heat a portion of the ink body near the heating element. A vapor bubble forms in the ink body between the heating element and the nozzle orifice when the portion of the ink body near the heating element reaches a predetermined temperature. Presence of the vapor bubble forces an ink drop out the nozzle orifice to form an image on a recording medium. A conductive heat removal structure is in thermal communication with the heating element and is also in fluid communication with the ink body. Heat is transferred from the heating element, through the substrate and into the heat removal structure. The heat removal structure then surrenders the heat to the ink body, which functions as an "infinite" heat sink in order to provide enhanced heat removal.

A feature of the present invention is the provision of a heat removal structure for enhanced removal of heat generated by the heating element.

An advantage of the present invention is that printing speed is increased.

Another advantage of the present invention is that use thereof allows for proper bubble formation (e.g., size of vapor bubble).

Still another advantage of the present invention is that risk of premature ejection of ink drops is reduced.

Yet another advantage of the present invention is that risk of accumulation of unintended vapor bubbles in the ink is reduced.

Moreover, another advantage of the present invention is that use thereof prolongs operational lifetime of the heating element.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE PREFERRED EMBODIMENT

The present invention will be directed in particular to elements forming part of, or cooperating more directly with, apparatus in accordance with the present invention. It is to be understood that elements not specifically shown or described may take various forms well known to those skilled in the art.

Figure 1:
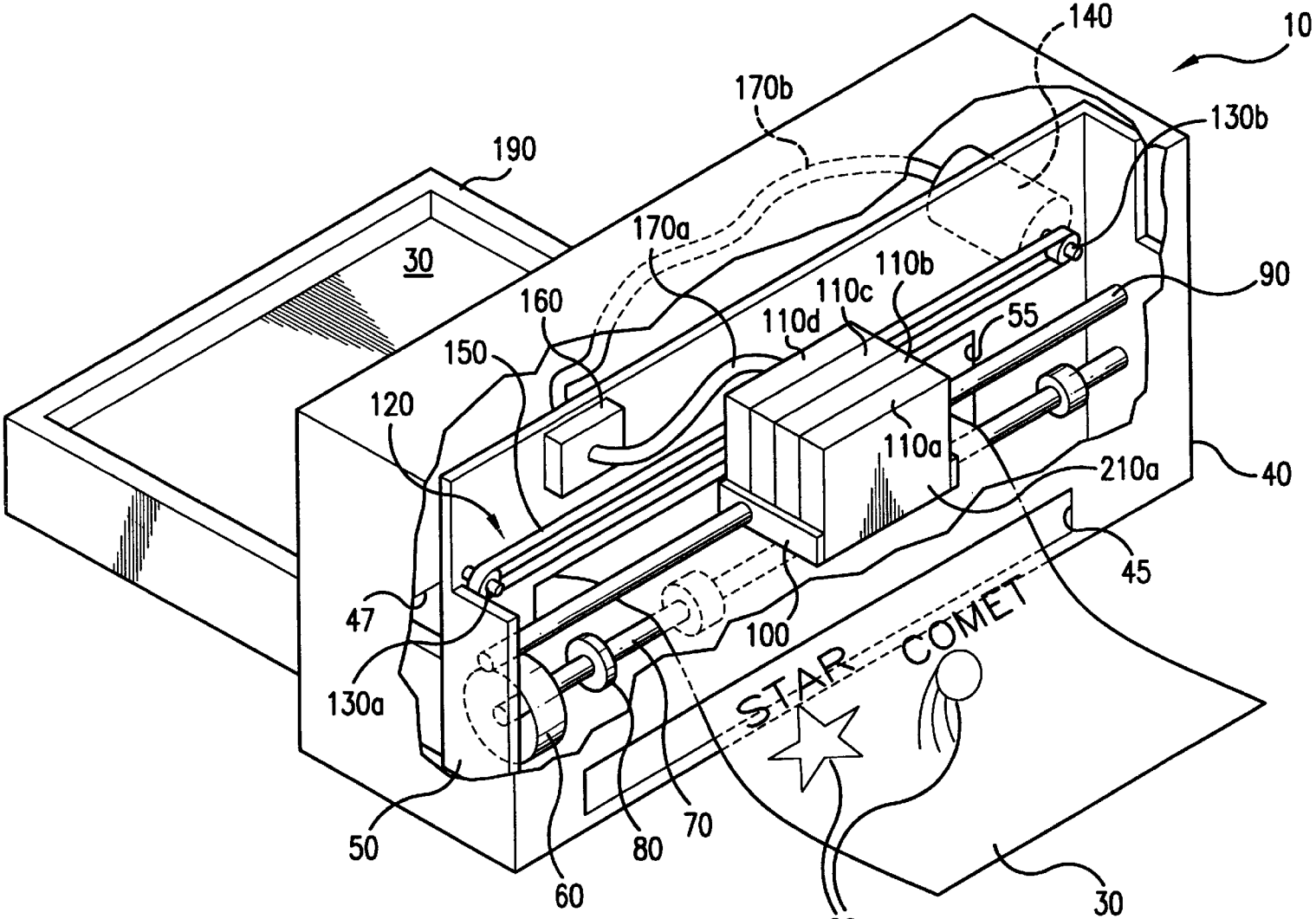
FIG. 1 is a view in perspective, with parts removed for clarity, of a thermal inkjet printer according to the present invention, the printer comprising a print head including a plurality of ink cartridges.

Therefore, referring to FIG. 1, there is shown a thermal inkjet printer, generally referred to as 10, for printing an image 20 on a recording medium 30. Recording medium 30 may be a reflective recording medium (e.g., paper) or a transmissive recording medium (e.g., transparency) or other type of recording medium suitable for receiving image 20. Printer 10 comprises a housing 40 having a first opening 45 and a second opening 47 therein for reasons disclosed presently. Disposed in housing 40 is an upright frame 50 defining an aperture 55 therein for reasons disclosed presently. Connected to frame 50 is a first motor 60, which may be a stepper motor, engaging an elongate spindle 70 for rotating spindle 70. Fixedly mounted on spindle 70 are a plurality of rollers 80 that rotate as spindle 70 is rotated by first motor 60. Also connected to frame 50 is an elongate slide bar 90 oriented parallel to spindle 70. Slidably engaging slide bar 90 is an ink cartridge holder 100 adapted to hold a plurality of generally rectangularly-shaped ink cartridges 110*a*, 110*b*, 110*c* and 110*d*. Ink cartridges 110*a*, 110*b*, 110*c* and 110*d* contain colorants such as yellow, magenta, cyan and black ink, respectively.

Referring again to FIG. 1, a belt drive assembly, generally referred to as 120, is also connected to frame 50. Belt drive assembly 120 comprises a plurality of oppositely disposed rollers 130*a* and 130*b* rotatably connected to frame 50. One of the rollers, such as roller 130*b*, engages a reversible second motor 140, which may be a stepper motor, for rotating roller 130*b*. In this case, roller 130*a* is configured to freely rotate while roller 130*b* is rotated by second motor 140. Wrapped around rollers 130*a* and 130*b* and spanning the distance therebetween is a continuous belt 150 affixed to ink cartridge holder 100. Thus, it may be appreciated from the description hereinabove, that operation of second motor 140 will cause roller 130*b* to rotate because roller 130*b* engages second motor 140. Belt 150 will rotate as roller 130*b* rotates because belt 150 engages roller 130*b*. Of course, roller 130*a* will also rotate as belt 150 rotates because roller 130*a* engages belt 150 and is freely rotatable. In this manner, cartridge holder 100 will slide to-and-fro or reciprocate along slide bar 90 as reversible second motor 140 rotates belt 150 first in a clockwise direction and then in a counter-clockwise direction. This to-and-fro reciprocating motion allows cartridge holder 100 and cartridges 110*a/b/c/d* held by cartridge holder 100 to traverse the width of recording medium 30 to print a swath of information on recording medium 30. After printing the swath of information, spindle 70 and associated rollers 80 rotate in the manner disclosed hereinabove to advance recording medium 30 the width of the swath and print another swath of information. This process is repeated until the desired image 20 is printed on recording medium 30. Also connected to frame 50 is a controller 160. Controller 160 is electrically coupled, such as by means of an electricity flow path or wire 170*a*, to ink cartridges 110*a/b/c/d* for selectively controlling operation of ink cartridges 110*a/b/c/d*, so that ink cartridges 110*a/b/c/d* eject an ink drop 180 on demand (see FIG. 2). Moreover, as shown in FIG. 1, controller 160 is electrically coupled, such as by means of an electricity flow path or wire 170*b*, to second motor 140 for controlling operation of second motor 140. In addition, controller 160 is electrically coupled to first motor 60, such as by means of another electricity flow path or wire (now shown), for controlling operation of first motor 60. Further, controller 160 is coupled to a picker mechanism (not shown) belonging to printer 10 for controlling operation of the picker mechanism. The picker mechanism "picks" individual sheets of recording medium 30 from a recording medium supply bin or tray 190 insertable into housing 40 through second opening 47. In this regard, the picker mechanism will "pick" and then feed an individual sheet of recording medium 30 from supply tray 190, through aperture 55 and into engagement with rollers 80, so that the sheet of recording medium 30 is interposed between ink cartridges 110*a/b/c/d* and rollers 80. Thus, it may be appreciated from the description hereinabove, that controller 160 controls synchronous operation of first motor 60, second motor 140, the picker mechanism and ink cartridges 110*a/b/c/d* for producing desired image 20 on recording medium 30. Input to controller 160 may be from an image processor, such as a personal computer or scanner (not shown).

Figure 2:
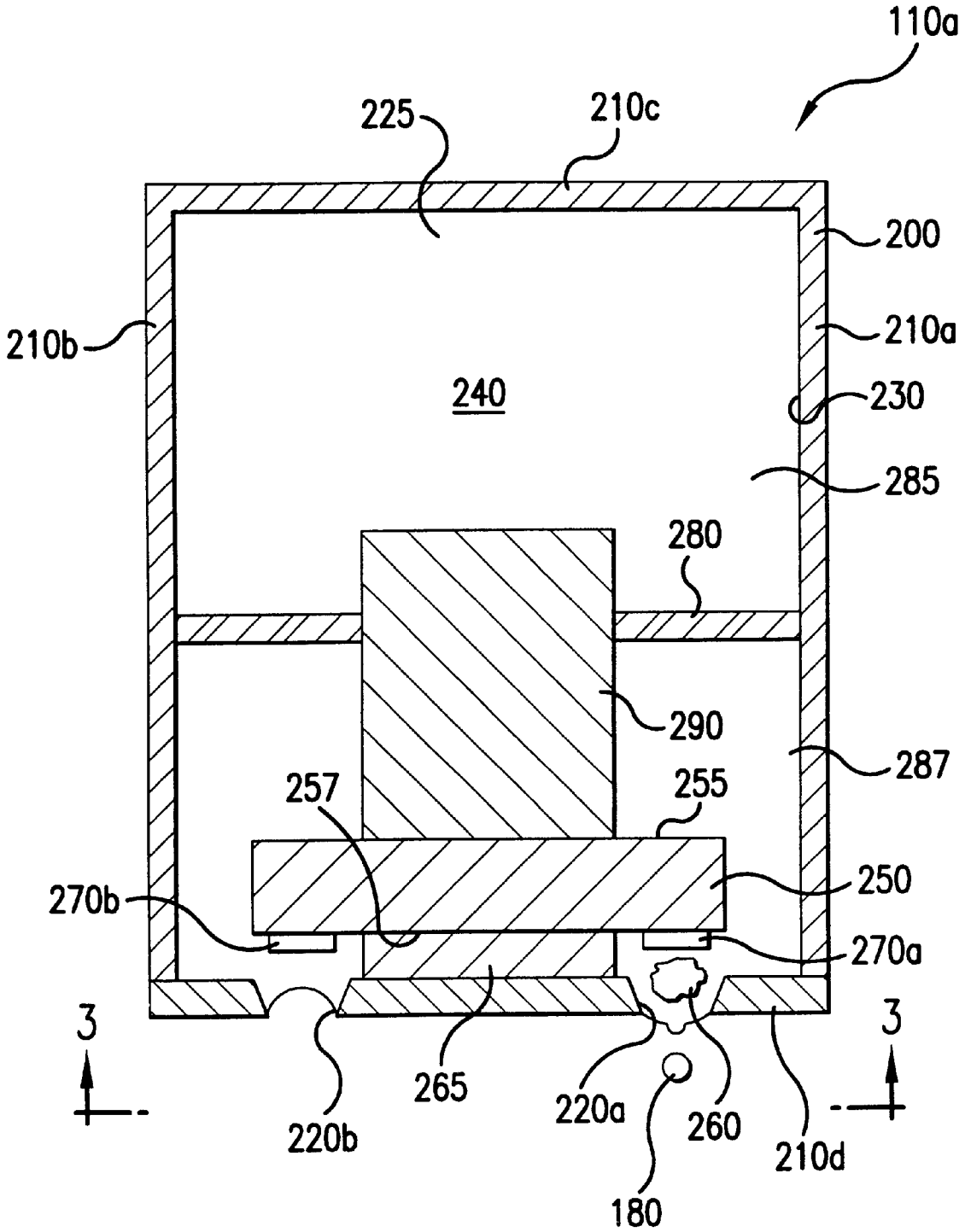
FIG. 2 is a view in elevation of a first embodiment of a representative one of the cartridges.
Figure 3:
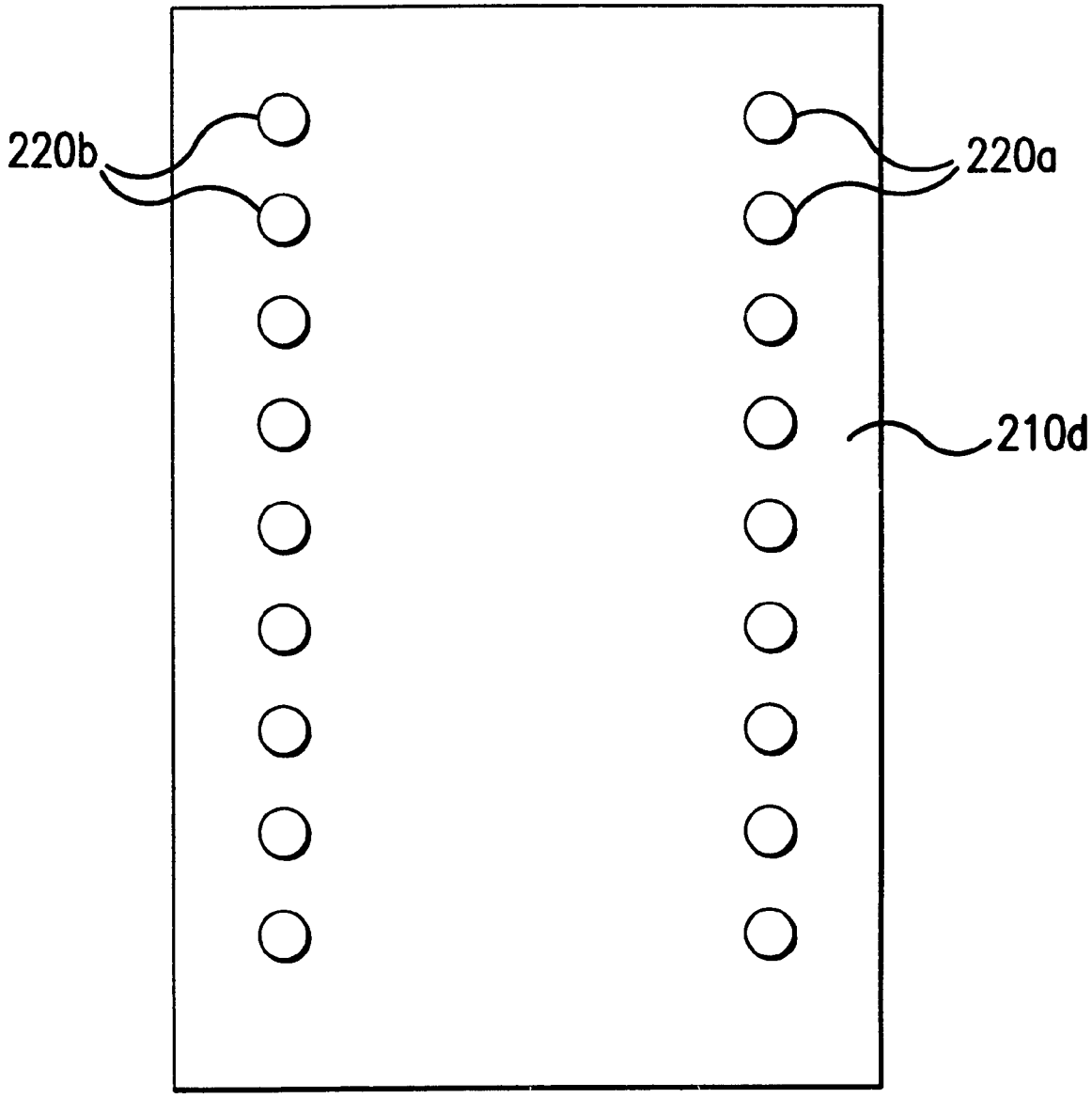
FIG. 3 is a view along section line 3—3 of FIG. 2.

Turning now to FIGS. 2 and 3, there is shown a first embodiment of a representative one of ink cartridges 110*a/b/c/d*, such as ink cartridge 110*a*. Ink cartridge 110*a* comprises a cartridge shell 200 including a first sidewall 210*a* disposed opposite and parallel to a second sidewall 210*b* and further including a top wall 210*c* integrally connected to sidewalls 210*a* and 210*b*. Spanning sidewalls 210*a* and 210*b* and integrally connected thereto and disposed opposite and parallel to top wall 210*c* is a bottom wall or nozzle plate 210*d* having a plurality of aligned nozzle orifices 220*a* and 220*b* formed therethrough and arranged in parallel rows. Of course, integrally connected to sidewalls 210*a* and 210*b*, top wall 210*c* and nozzle plate 210*d* is a front wall (not shown). Further, integrally connected to sidewalls 210*a* and 210*b*, top wall 210*c* and disposed parallel to the front wall is a rear wall 225. Thus, it may be understood from the description immediately hereinabove, that sidewalls 210*a* and 210*b*, top wall 210*c*, nozzle plate 210*d*, the front wall and rear wall 225 together define a chamber 230 for receiving an ink body 240 therein.

Still referring to FIGS. 2 and 3, disposed in chamber 230 is a rectangularly-shaped heat conductive die or substrate 250, which defines a top surface 255 and a bottom surface 257 opposite top surface 255. Substrate 250 is spaced apart from nozzle plate 210*d* to define a gap therebetween to allow space for formation of a vapor bubble 260, in a manner disclosed presently. Substrate 250 is preferably formed of silicon dioxide, but may be formed of plastic, metal, glass, or ceramic if desired. In addition, substrate 250 is supported by a base 265 coupled to nozzle plate 210*d*. Coupled to bottom surface 257 are a plurality of aligned first heating elements or first thin-film thermal resistors 270*a* spaced along the length of rectangularly-shaped substrate 250 and disposed opposite respective ones of nozzle orifices 220*a*. Moreover, coupled to bottom surface 257 are a plurality of aligned second heating elements or second thin-film thermal resistors 270*b* spaced along the length of rectangularly-shaped substrate 250 and disposed opposite respective ones of nozzle orifices 220*b*. Each resistor 270*a/b* is electrically connected to previously mentioned controller 160, so that controller 160 selectively controls flow of electric current to resistors 270*a/b*. Of course, when controller 160 supplies electricity to any of resistors 270*a/b*, the resistor 270*a/b* generates heats, thereby heating ink adjacent to resistor 270*a/b* to form vapor bubble 260. In other words, controller 160 controllably supplies a plurality of electrical pulses to resistors 270*a/b* for selectively energizing resistors 270*a/b* so that vapor bubble 260 forms. Vapor bubble 260 will in turn pressurize ink body 240 to force or squeeze ink drop 180 out nozzle orifice 220*a/b* disposed opposite resistor 270*a/b*. Such a thermal resistor 270*a/b* and associated electrical circuitry is disclosed more fully in U.S. patent application Ser. No. 08/962,031, filed Oct. 31, 1997, titled "Ink Delivery System for High Speed Printing" and assigned to the assignee of the present invention, the disclosure of which is hereby incorporated by reference. Also disposed in chamber 230 and connected to sidewalls 210*a/b* is a filter 280 bifurcating chamber 230 into an ink reservoir region 285 and a firing chamber region 287. The purpose of filter 280 is to filter particulate matter from ink body 240, so that the particulate matter does not migrate to and block nozzle orifices 220*a/b*. Thus, ink body 240 flows from ink reservoir region 285, through filter 280 and into firing chamber region 287 to come into contact with resistors 270*a/b*, so that resistors 270*a/b* are in fluid communication with ink body 240..

As previously mentioned, prior art efforts to increase print resolution and printing speed by increasing the number and density of thermal resistors on the print head and increasing firing frequency of the thermal resistors may result in excessive heat generation in the print head. Excessive heat generation in the print head interferes with proper bubble formation, prematurely ejects ink drops, causes unintended vapor bubbles to accumulate in the ink, and ultimately may shorten operational lifetime of the resistors. Therefore, it is highly desirable to remove the heat generated by the resistors in the print head after formation of the vapor bubble.

Therefore, as best seen in FIG. 2, a rectangularly-shaped heat removal structure 290 is connected to top surface 255 of substrate 250. Heat removal structure 290 is made of a highly heat conductive material, such as aluminum having a thermal conductivity of approximately 119 Btu/hr ft ° zF. at 212° F. Alternatively, heat removal structure 290 may be made of a material having thermal conductivity known to increase with increasing temperature and decrease with decreasing temperature, such as potassium silicates, lead silicates, ternary carbides, ternary oxides and ternary nitrides. The width of heat removal structure 290 extends the length of substrate 250 and is preferably connected to substrate 250 by means of a suitable highly heat conductive adhesive. Moreover, it may be appreciated from the description hereinabove that the height of heat removal structure 290 may be such that heat removal structure 290 protrudes through filter 280.

Still referring to FIG. 2, when a selected one of resistors 270*a/b* is energized by controller 160, heat is transferred from resistor 270*a/b* to substrate 250 as vapor bubble 260 forms. This heat is conducted through substrate 250 to heat removal structure 290. Heat removal structure 290 surrenders this heat to the surrounding ink body 240. In this regard, ink body 240 has a volume of approximately 20 cubic centimeters and therefore effectively functions as an "infinite" heat sink. Although some heat leaves substrate 250 by means of ink drop 180, the volume (e.g., between approximately 4 to 20 pico liters) of ink drop 180 is limited; therefore, the amount of heat taken away from substrate 250 by ink drop 180 is similarly limited. However, heat removal structure 290 of the present invention removes substantially more heat from substrate 250 because heat removal structure 290 delivers this heat to a substantially infinite heat sink (i.e., ink body 240).

Figure 4:
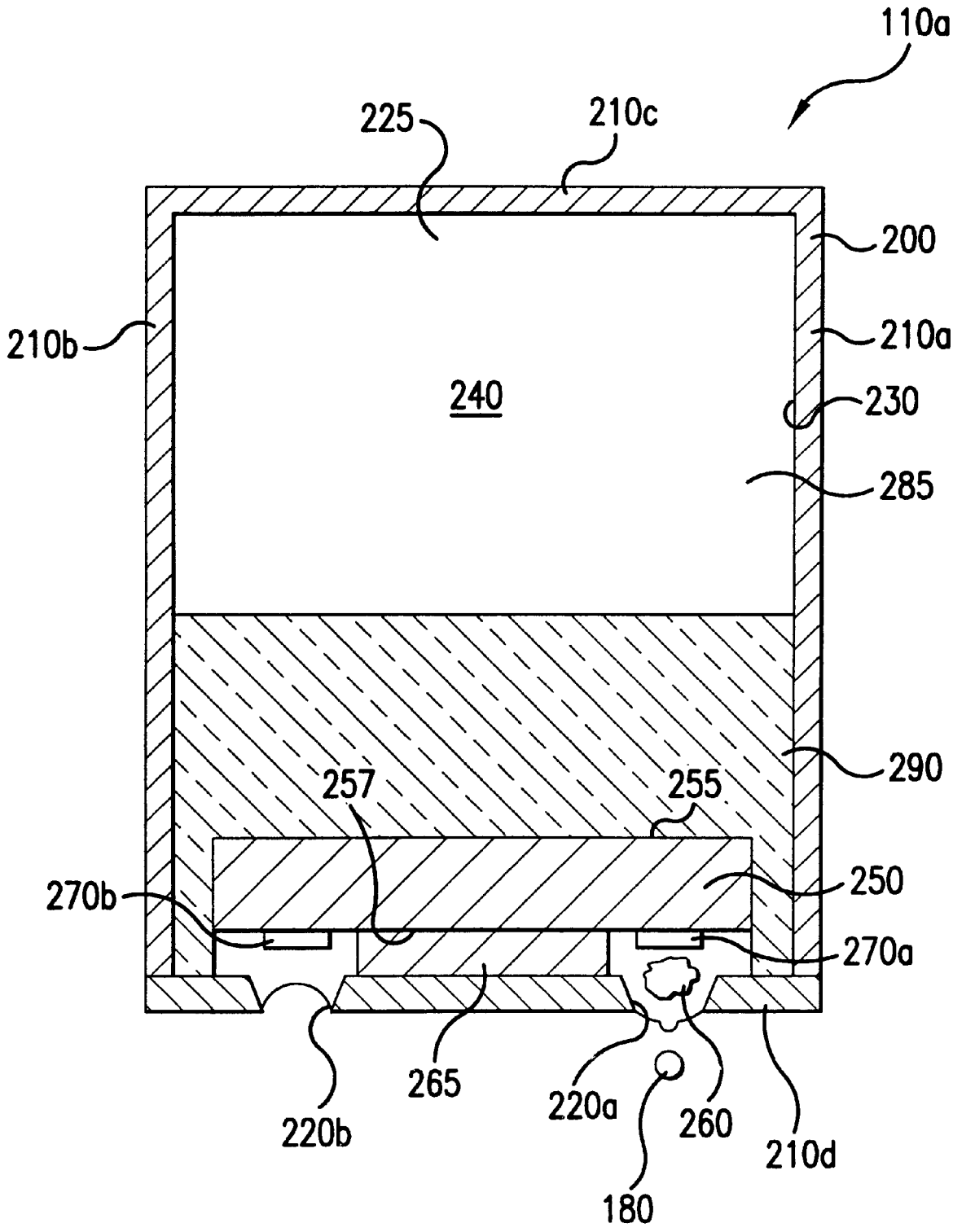
FIG. 4 is a view in elevation of a second embodiment of a representative one of the cartridges.

Referring to FIG. 4, a representative one of a second embodiment of ink cartridges 110*a/b/c/d* is there shown. This second embodiment ink cartridge, such as ink cartridge 110*a*, is substantially similar to the first embodiment ink cartridge, except heat removal structure 290 is a porous sintered filter material, such as stainless steel having a thermal conductivity of approximately 9.4 Btu/hr ft ° F. at 212° F. Heat removal structure 290 covers all surfaces of substrate 250 except for bottom surface 257 and extends into contact with sidewalls 210*a/b*, rear wall 225 and the front wall of cartridge 110*a*. It may be understood from the description immediately hereinabove that heat removal structure 290 serves a dual function of filtering ink body 240 as well as removing heat from substrate 250. Therefore, heat removal structure 290 advantageously eliminates need for a separate filter member.

Figure 5:
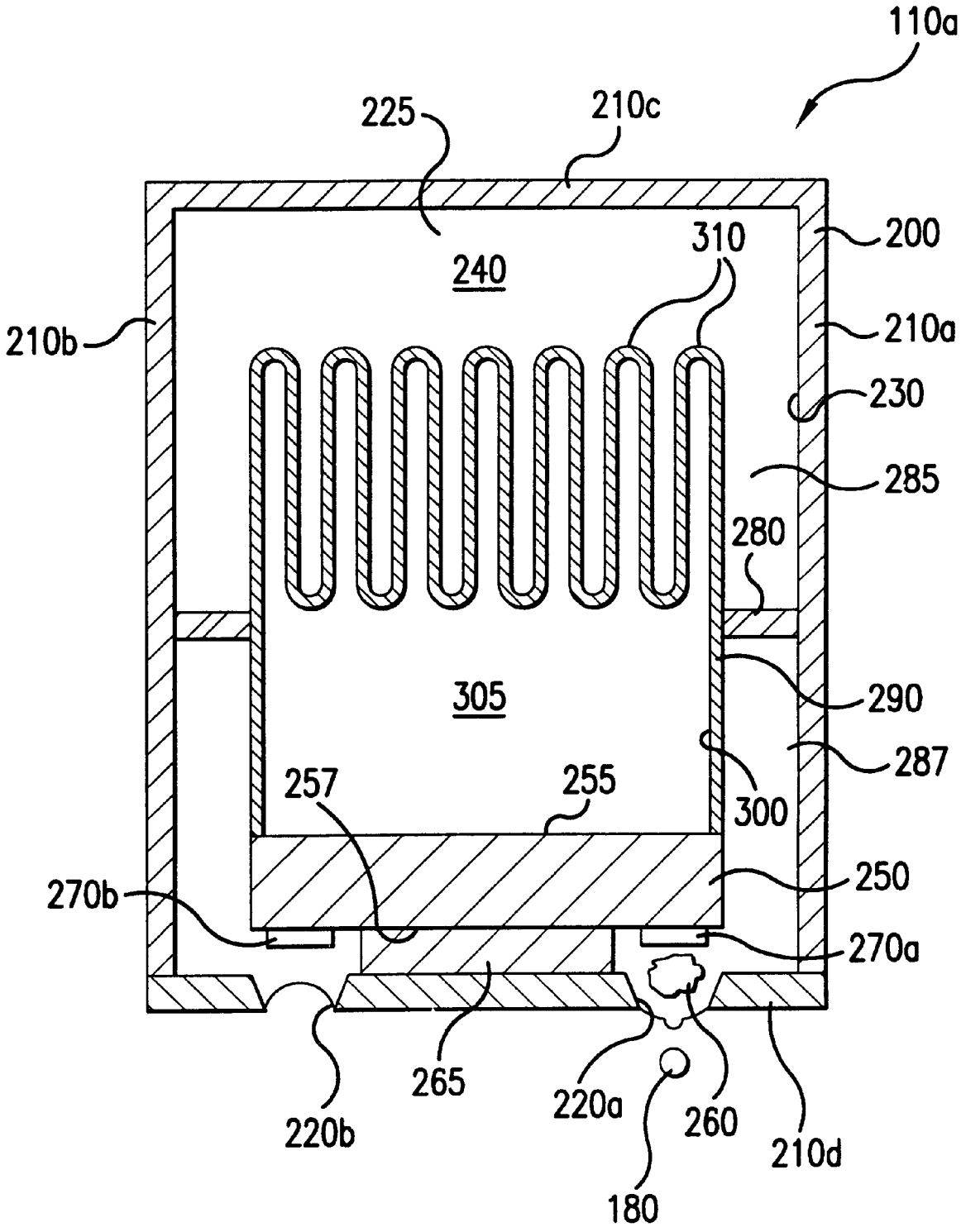
FIG. 5 is a view in elevation of a third embodiment of a representative one of the cartridges.

Referring to FIG. 5, a representative one of a third embodiment of ink cartridges 110*a/b/c/d* is there shown. This third embodiment ink cartridge, such as ink cartridge 110*a*, is substantially similar to the first embodiment ink cartridge, except heat removal structure 290 defines a cooling chamber 300 for receiving an aqueous coolant 305, such as water or ink, of a predetermined temperature that may be lower than the temperature of ink body 240. Coolant 305 contacts top surface 255 of substrate 250 so that heat is transferred from substrate 250 to coolant 305. Heat removal structure 290 also defines a plurality of finger-like projections or protuberances 310 extending into ink body 240 and that are filled with coolant 305. Presence of protuberances 310 increases surface area of heat removal structure 290 to enhance transfer of heat from heat removal structure 290 (and thus substrate 250) to ink body 240.

Figure 6:
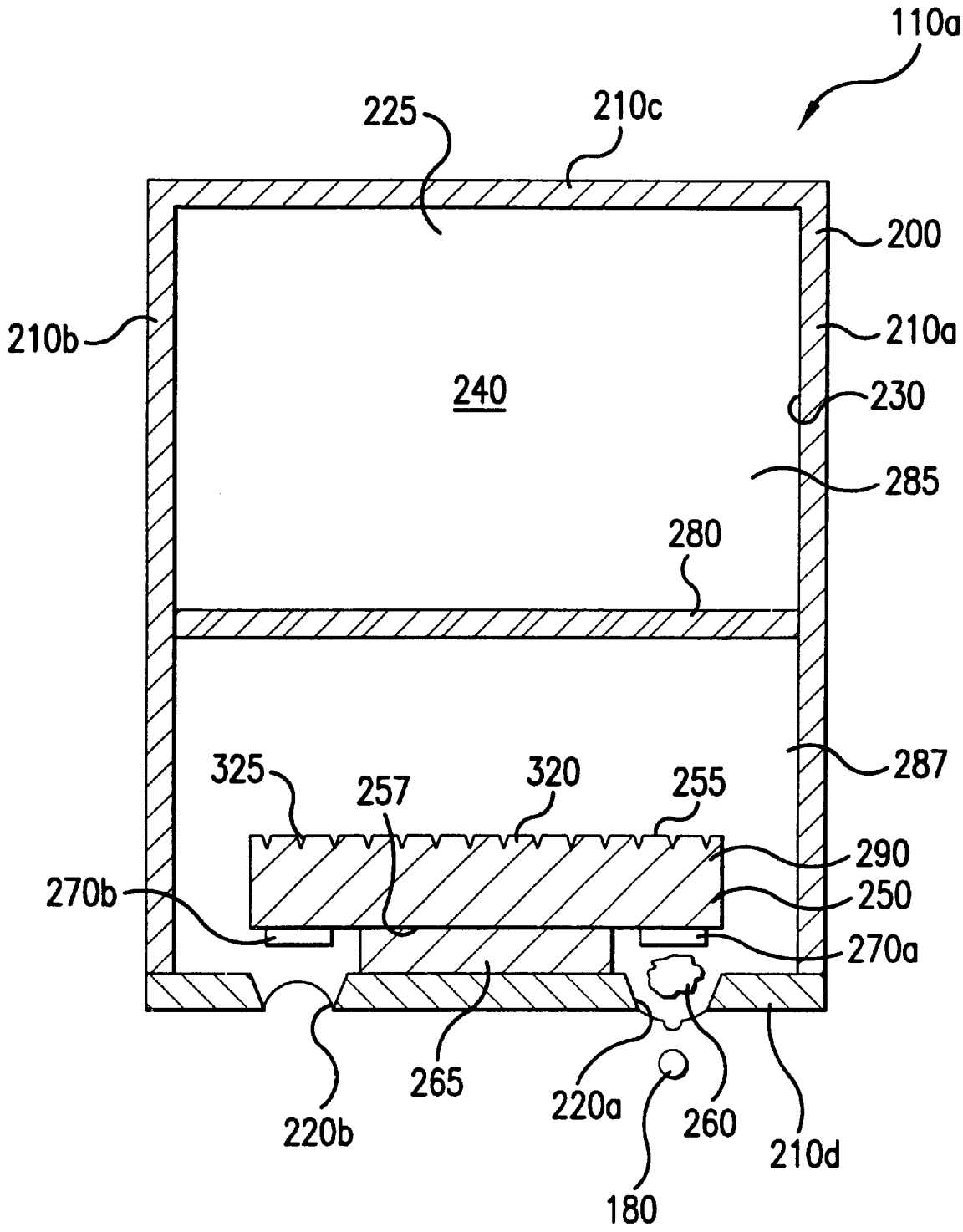
FIG. 6 is a view in elevation of a fourth embodiment of a representative one of the cartridges.

Referring to FIG. 6, a representative one of a fourth embodiment of ink cartridges 110*a/b/c/d* is there shown. This fourth embodiment ink cartridge, such as ink cartridge 110*a*, is substantially similar to the first embodiment ink cartridge, except heat removal structure 290 and substrate 250 are integrally formed as one unitary member. That is, attached or etched on top surface 255 of substrate 250 are a plurality of adjacent elongate and parallel fins 320 separated by intervening grooves 325. Fins 320, and associated grooves 325, extend longitudinally along the length of rectangularly-shaped substrate 250. Presence of fins 320 increases surface area of the unitary heat removal structure 290 and substrate 250 to enhance transfer of heat to ink body 240.

Figure 7:
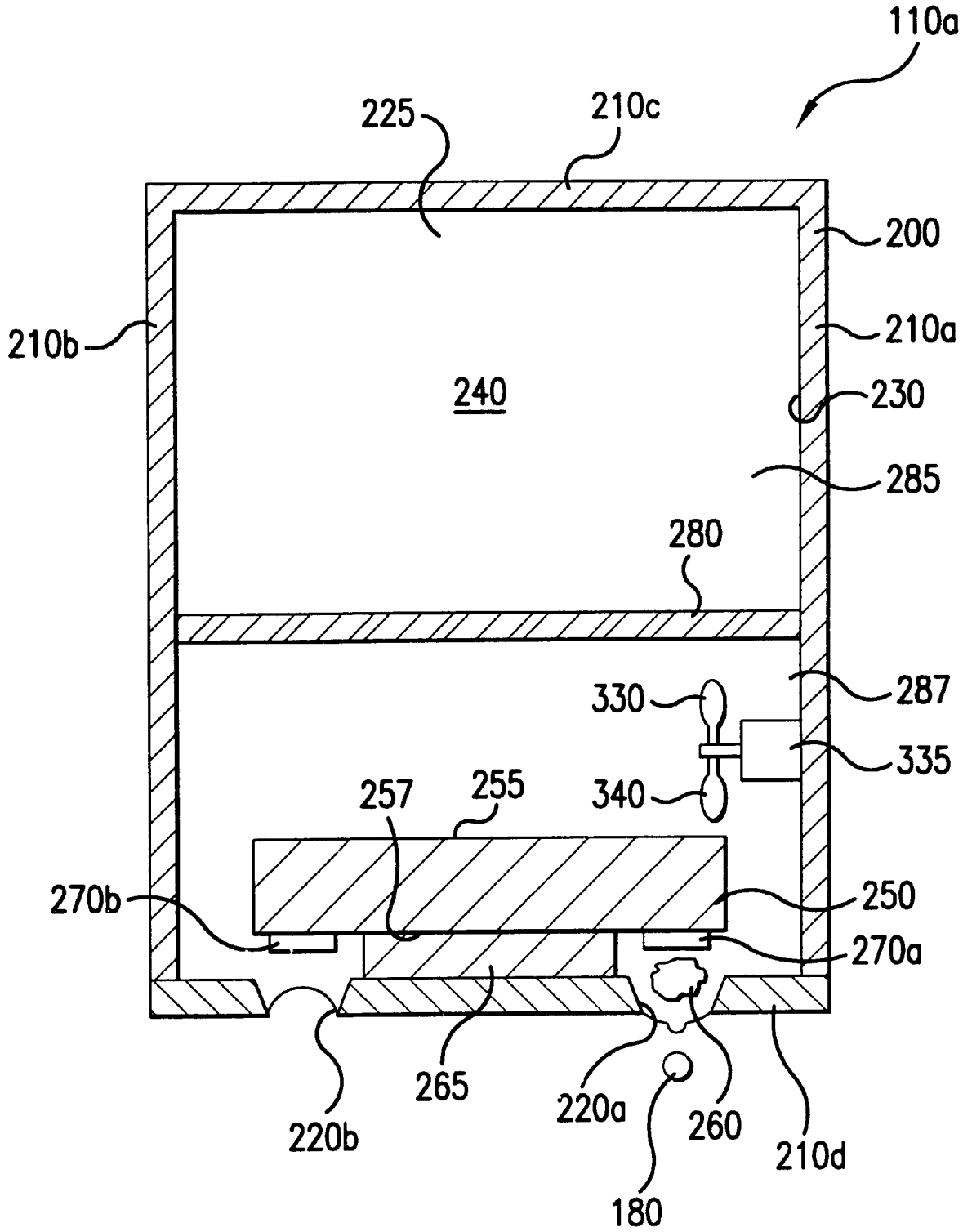
FIG. 7 is a view in elevation of a fifth embodiment of a representative one of the cartridges.

Referring to FIG. 7, a representative one of a fifth embodiment of ink cartridges 110*a/b/c/d* is there shown. This fifth embodiment ink cartridge, such as ink cartridge 110*a*, is substantially similar to the first embodiment ink cartridge, except the heat removal structure comprises a first embodiment agitator 330 in the form of a rotatable propeller 340 connected, for example, to the inside of sidewall 210*a*. Propeller 340 engages a motor 335 for rotating propeller 340. Propeller 340 is in fluid communication with ink body 240 for agitating ink body 240 so that heat transferred from substrate 250 to ink body 240 is uniformly dispersed throughout ink body 240. Uniformly dispersing the heat throughout ink body 240 aids in removing heat from vicinity of substrate 250. In other words, propeller 340 provides forced convection of the heat in ink reservoir region 285 and firing chamber region 287 for more enhanced heat transfer than is achievable by natural convection alone.

Figure 8:
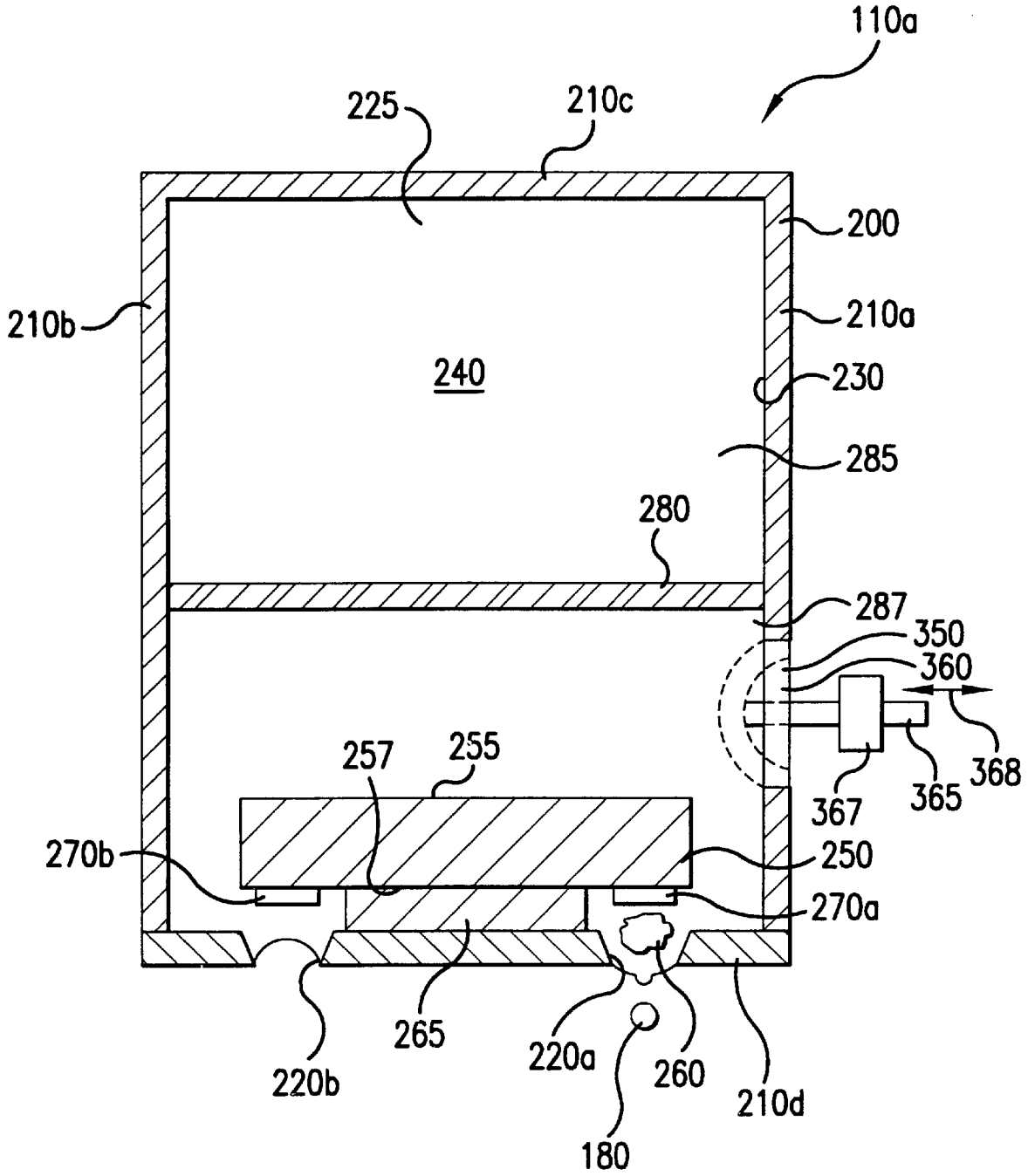
FIG. 8 is a view in elevation of a sixth embodiment of a representative one of the cartridges.

Referring to FIG. 8, a representative one of a sixth embodiment of ink cartridges 110*a/b/c/d* is there shown. This sixth embodiment ink cartridge, such as ink cartridge 110*a*, is substantially similar to the first embodiment ink cartridge, except the heat removal structure comprises a second embodiment agitator 350 in the form of an oscillatable elastic membrane 360 disposed in sidewall 210*a* of cartridge 110*a*. Membrane 360, which may be rubber, engages a piston member 365 for extending elastic membrane 360 into ink body 240. Piston member 365 in turn engages a piston actuator 367 that actuates piston member 365, so that piston member 365 reciprocates in direction of double-headed arrow 368. Membrane 360 elastically extends into ink body 240, in an oscillatory fashion, for agitating ink body 240 so that heat transferred from substrate 250 to ink body 240 is uniformly dispersed throughout ink body 240. Uniformly dispersing the heat throughout ink body 240 aids in removing heat from vicinity of substrate 250. In other words, membrane 360 provides forced convection of the heat in ink reservoir region 285 and firing chamber region 287 for more enhanced heat transfer than is achievable by natural convection alone.

Figure 9:
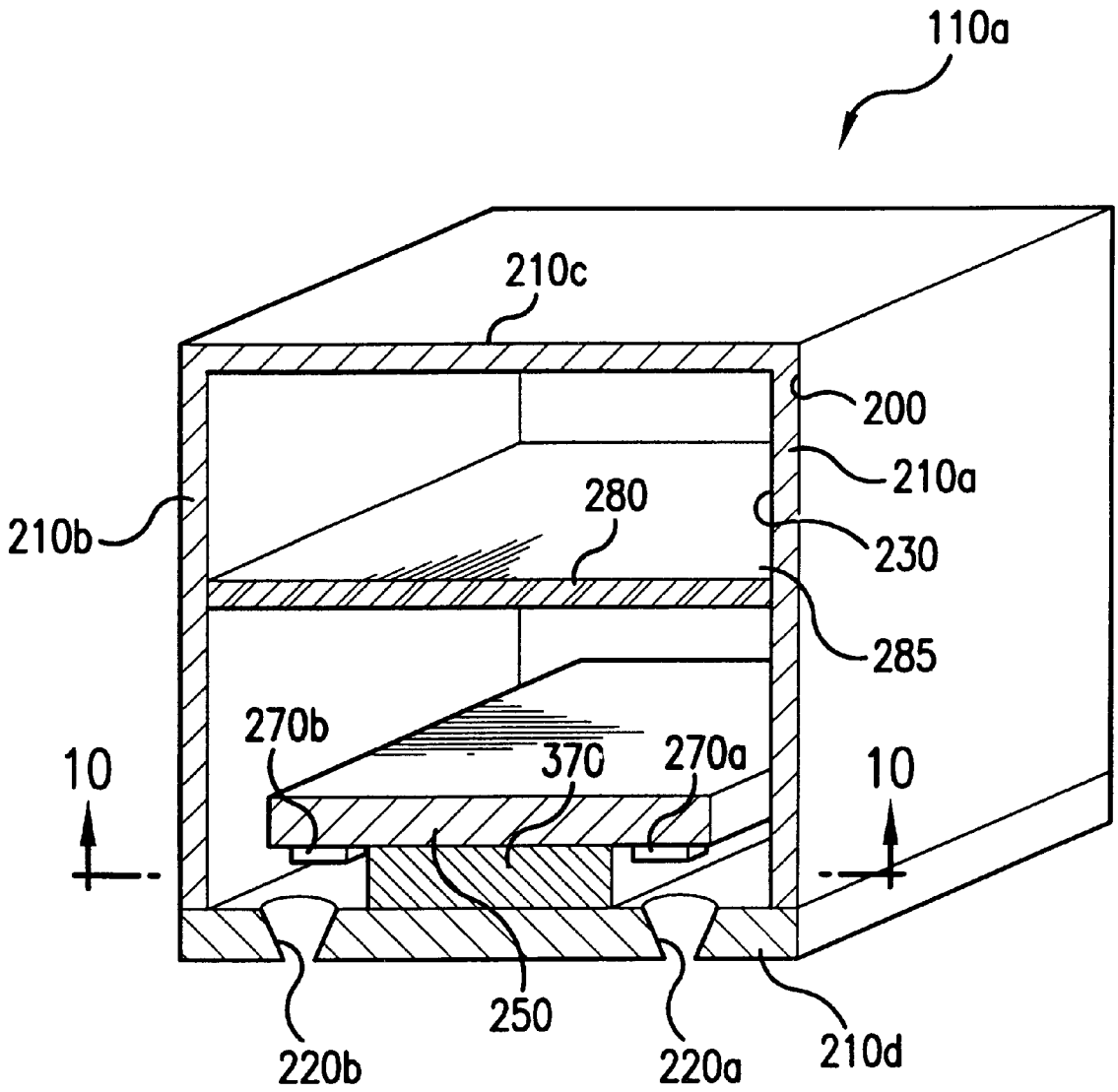
FIG. 9 is a perspective view in elevation of a seventh embodiment of a representative one of the cartridges.
Figure 10:
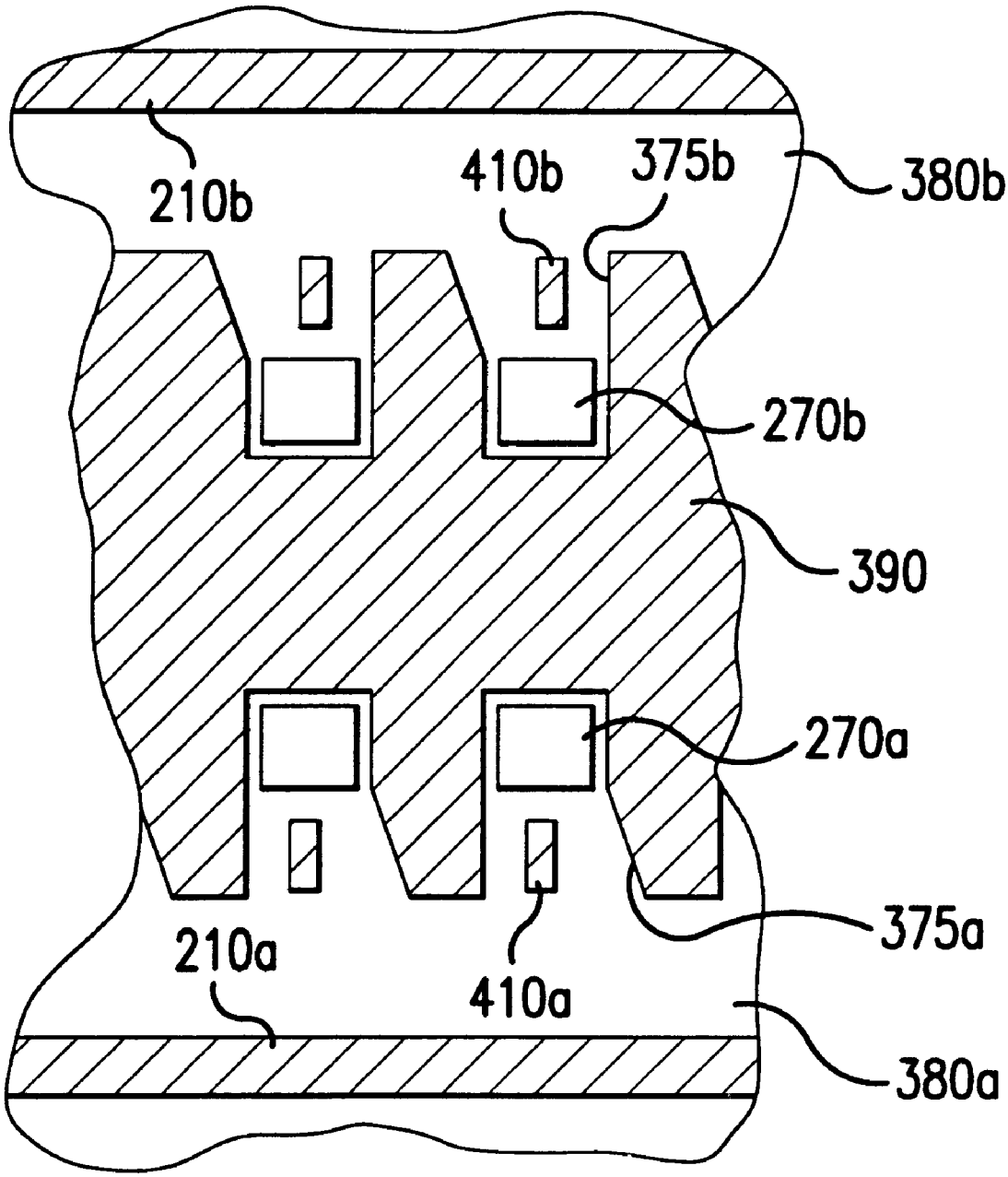
FIG. 10 is a fragmentation view along section line 10—10 of FIG. 9.

Referring to FIGS. 9 and 10, a representative one of a seventh embodiment of ink cartridges 110*a/b/c/d* is there shown. This seventh embodiment ink cartridge, such as ink cartridge 110*a*, is substantially similar to the first embodiment ink cartridge, except the heat removal structure comprises an elongate septum 370 connected to substrate 250 and nozzle plate 210*d* and interposed therebetween (similar to base 265). Formed in septum 370 are a plurality of first recesses 375*a* and second recesses 375*b* for reasons disclosed presently. Septum 370 extends the length of rectangularly-shaped substrate 250 and runs between resistors 270*a* and 270*b*. In this manner, septum 370 partitions firing chamber region 287 into a first ink flow channel 380*a* and a second ink flow channel 380*b*. Second ink flow channel 380*b* extends parallel to first ink flow channel 380*a*. First resistor 270*a* is disposed in first recess 367*a* and second resistor 270*b* is disposed in second recess 375*b*. Moreover, disposed in first ink flow channel 380*a* and adjacent to each first resistor 270*a* is a first barrier block 410*a* (only two of which are shown), which is connected to nozzle plate 210*d* and substrate 250. In addition, disposed in second ink flow channel 380*b* and adjacent to each second resistor 270*b* is a second barrier block 410*b* (only two of which are shown), which is connected to nozzle plate 210*d* and substrate 250. The purpose of barrier blocks 410*a/b* is to create a pressure differential recesses 375*a/b* in order to generate an increased flow of cooling ink through recesses 375*a/b* with every firing event of the resistors 270*a/b*.

Figure 11:
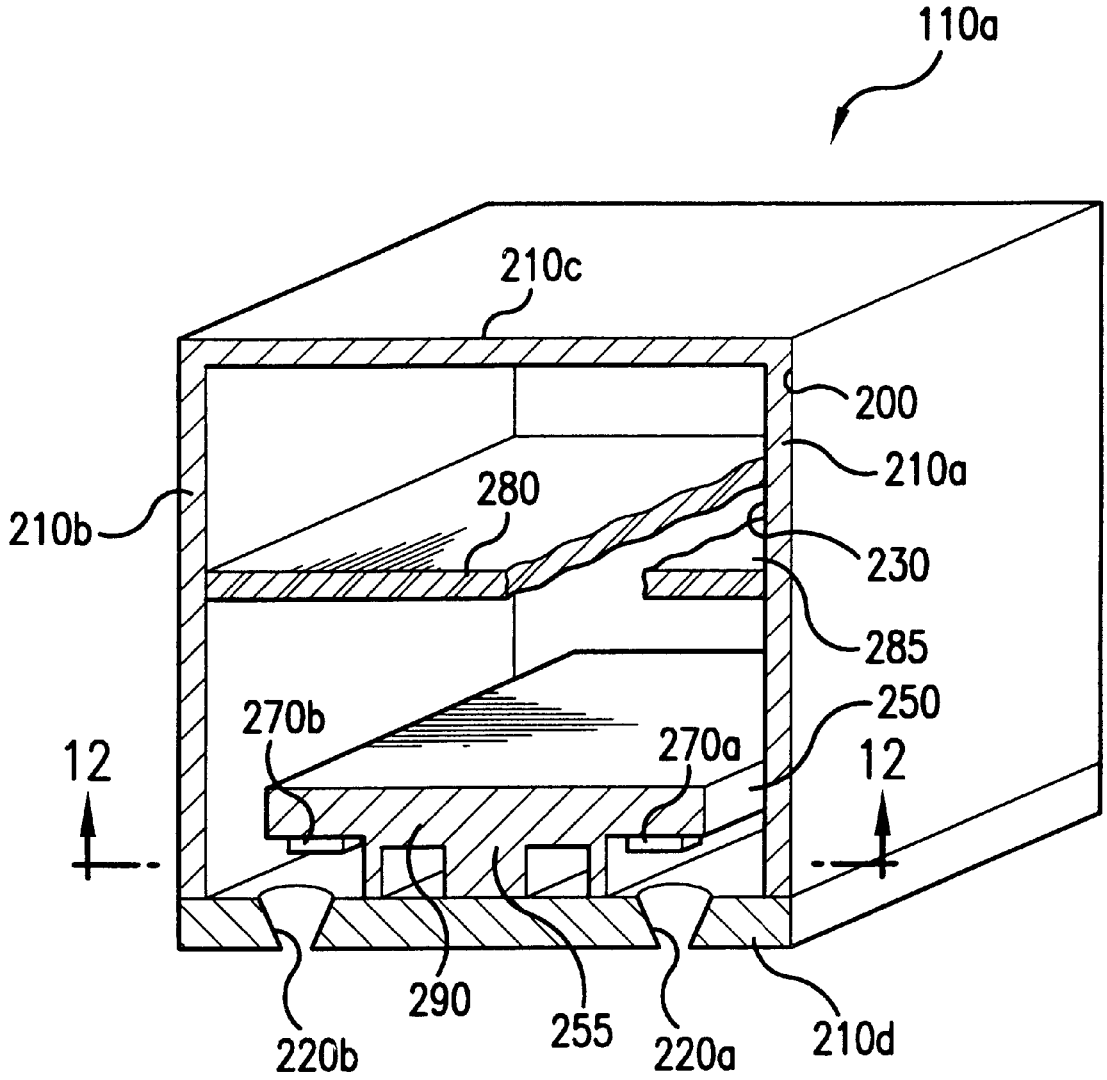
FIG. 11 is a perspective view in partial elevation of an eighth embodiment of a representative one of the cartridges.
Figure 12:
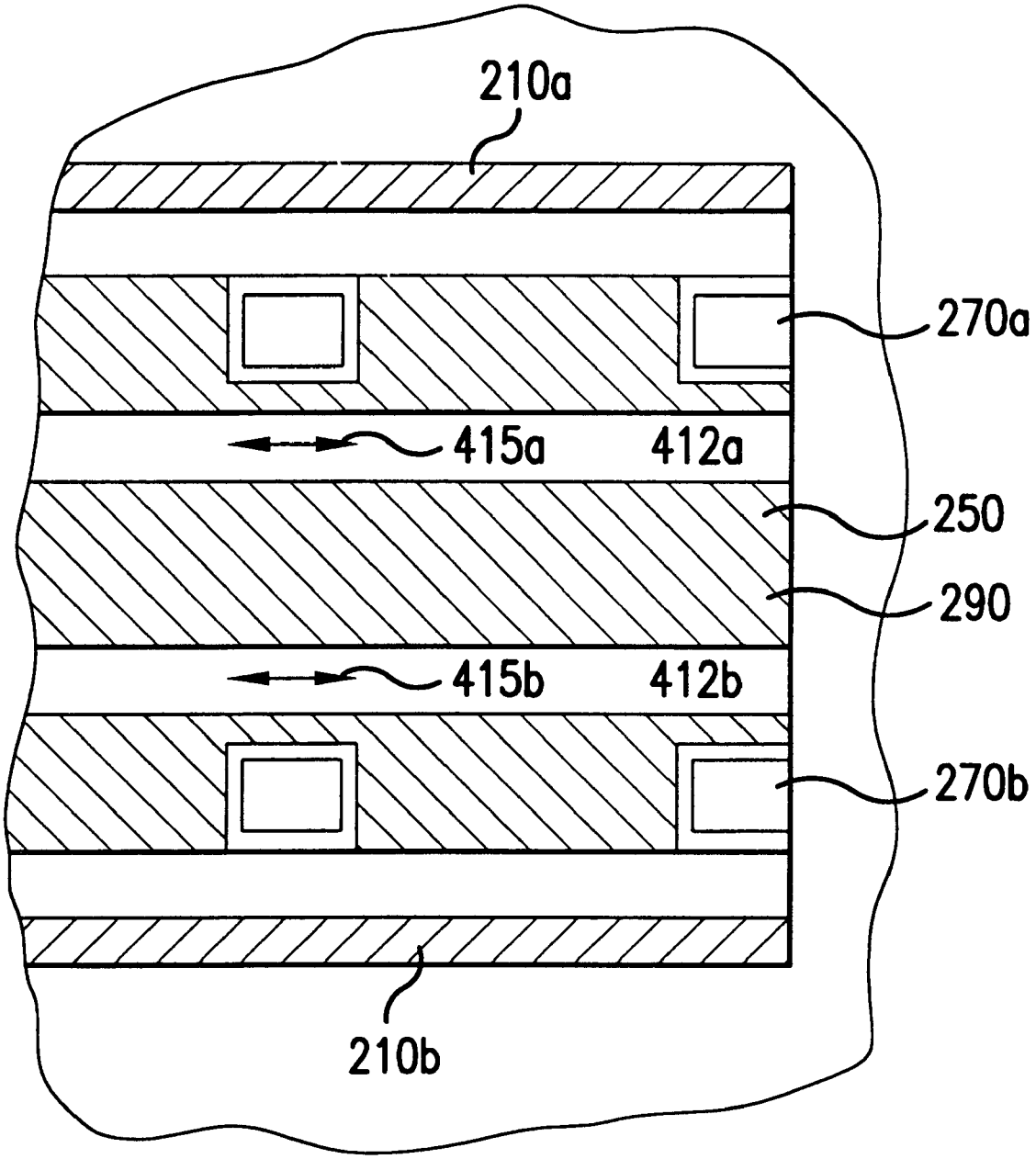
FIG. 12 is a fragmentation view taken along section line 12—12 of FIG. 11.

Referring to FIGS. 11 and 12, a representative one of an eighth embodiment of ink cartridges 110*a/b/c/d* is there shown. This eighth embodiment ink cartridge, such as ink cartridge 110*a*, is substantially similar to the first embodiment ink cartridge, except heat removal structure 290 is integrally formed with substrate 250 as a unitary structure, so as to define a first tunnel 412*a* and a second tunnel 412*b* extending longitudinally along the unitary structure comprising substrate 250 and heat removal structure 290. A pump (not shown) pumps coolant into and out of tunnels 412*a/b* in the directions illustrated by double-headed arrows 415*a* and 415*b* for removing heat from the combined substrate 250 and heat removal structure 290.

Figure 13:
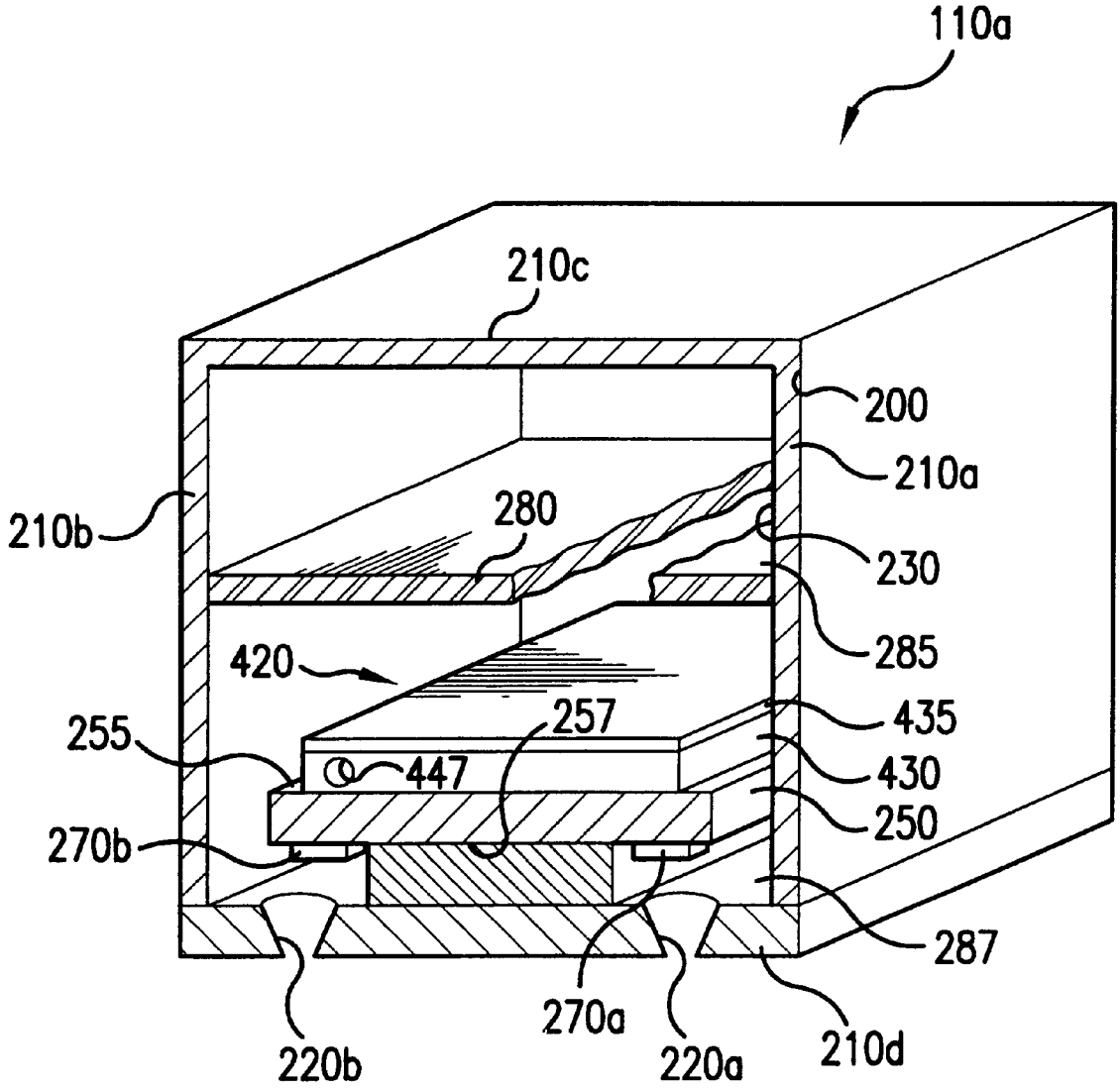
FIG. 13 is a perspective view in partial elevation of a ninth embodiment of a representative one of the cartridges.
Figure 14:
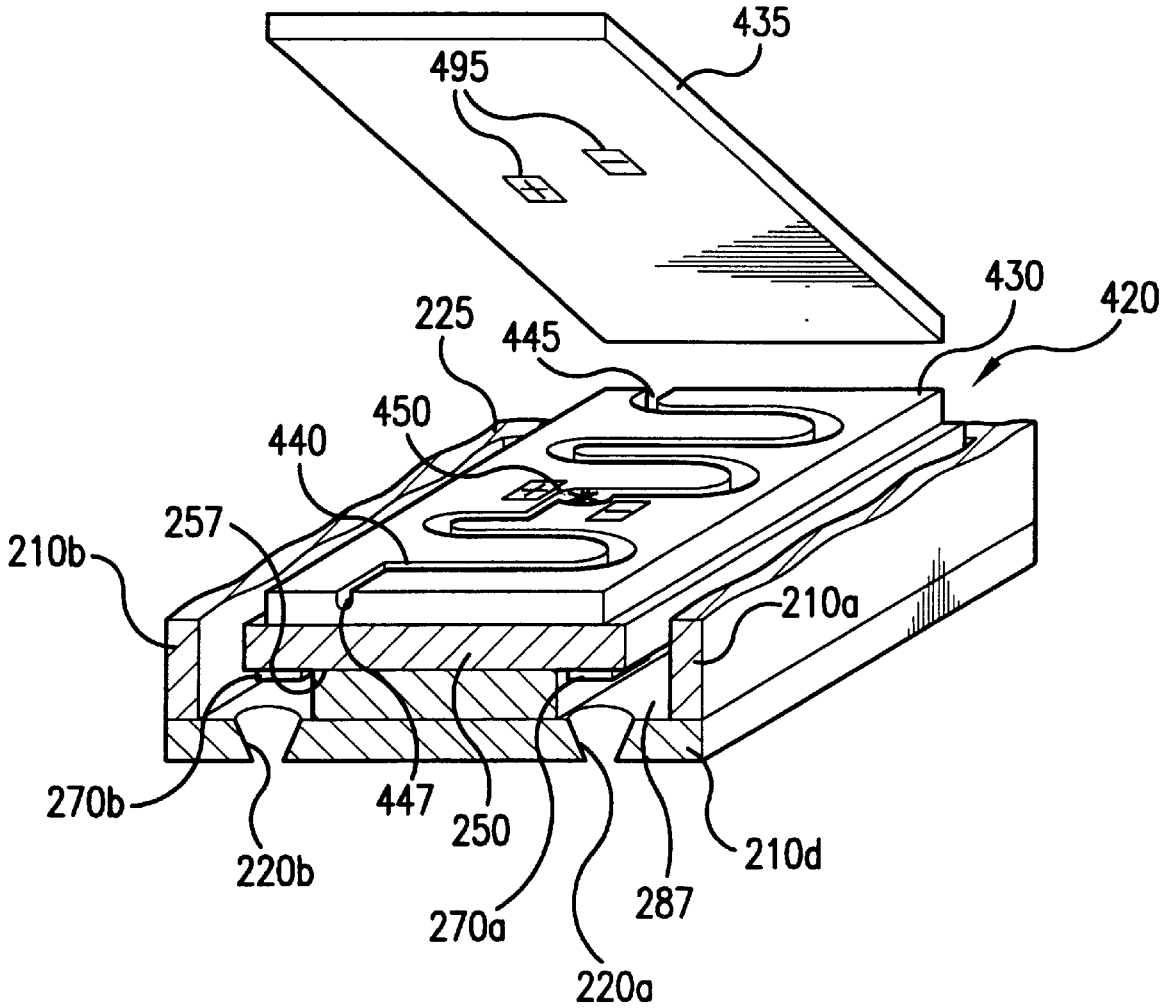
FIG. 14 is an exploded perspective view in partial elevation, and with parts removed for clarity, of the ninth embodiment of the cartridge.
Figure 15:
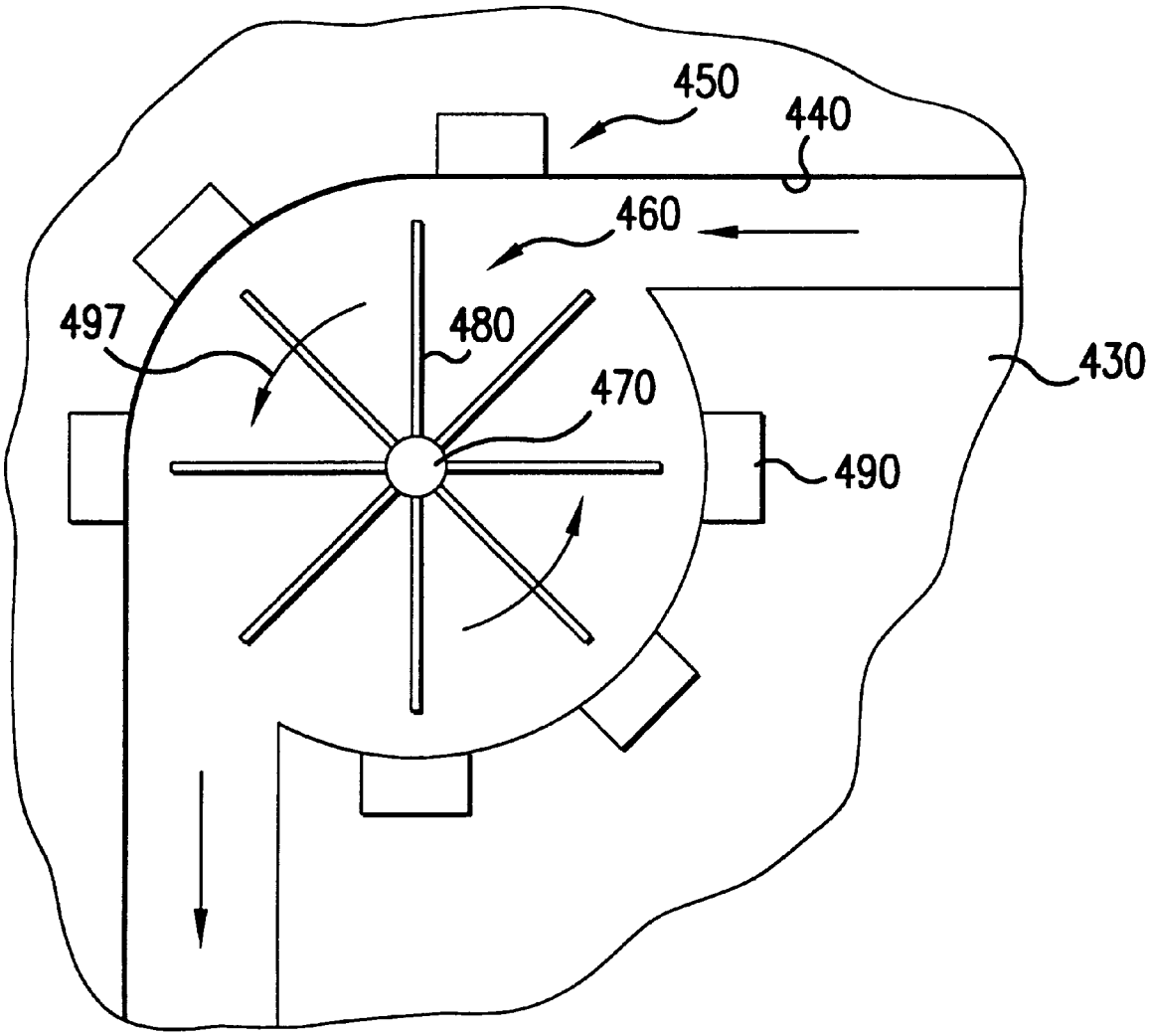
FIG. 15 is a fragmentation view of the ninth embodiment of the cartridge.

Referring to FIGS. 13, 14 and 15, a representative one of an ninth embodiment of ink cartridges 110*a/b/c/d* is there shown. This ninth embodiment ink cartridge, such as ink cartridge 110*a*, is similar to the first embodiment ink cartridge, except heat removal structure 290 comprises a rectangularly-shaped radiator assembly, generally referred to as 420, for removing heat from substrate 250. Radiator assembly 420 comprises a radiator block 430 connected to top surface 255 of substrate 250. Radiator block 430 is connected to top surface 255 such as by a suitable highly conductive adhesive. Radiator block 430 includes a cover 435 and defines a serpentine-shaped ink flow channel 440 formed longitudinally in radiator block 430. Also, radiator block 430 defines an ink inlet 445 for ingress of ink into flow channel 440 and an ink outlet 447 for exit of the ink out flow channel 440. Flow of ink in flow channel 440 is achieved by operation of an internal first embodiment micro-pump assembly 450, generally referred to as 450, disposed in flow channel 440. Micro-pump assembly 450 includes a wheel, generally referred to as 460, that in turn includes a freely-rotatable axle 470. Arranged around axle 470 and connected thereto are a plurality of spaced-apart magnetic spokes 480. Surrounding spokes 480 are a plurality of electromagnets 490 for exerting an electromagnetic force on spokes 480. Electromagnets 490 are in turn connected to electrical contacts 495 that selectively actuate electromagnets 490. In this regard, electrical contacts 495 may be connected to controller 160 for controllably supplying electrical current to electrical contacts 495. Electromagnets 490 are sequentially energized in a clockwise fashion, so that magnetic spokes 480 will rotate in a clockwise fashion in direction of arrow 497 due to the electromagnetic force exerted on spokes 480. In this manner, micro-pump assembly 450 pumps ink through ink flow channel 440 for removing heat from substrate 250. In other words, substrate 250 transfers heat from firing chamber region 287 to radiator block 430, whereupon ink pumped through ink flow channel 440 removes the heat and delivers the heat to ink body 240. Alternatively, serpentine-shaped ink flow channel 440 may be etched into the backside of substrate 250, thereby eliminating need for radiator assembly 430 and requiring only cover 435.

Figure 16:
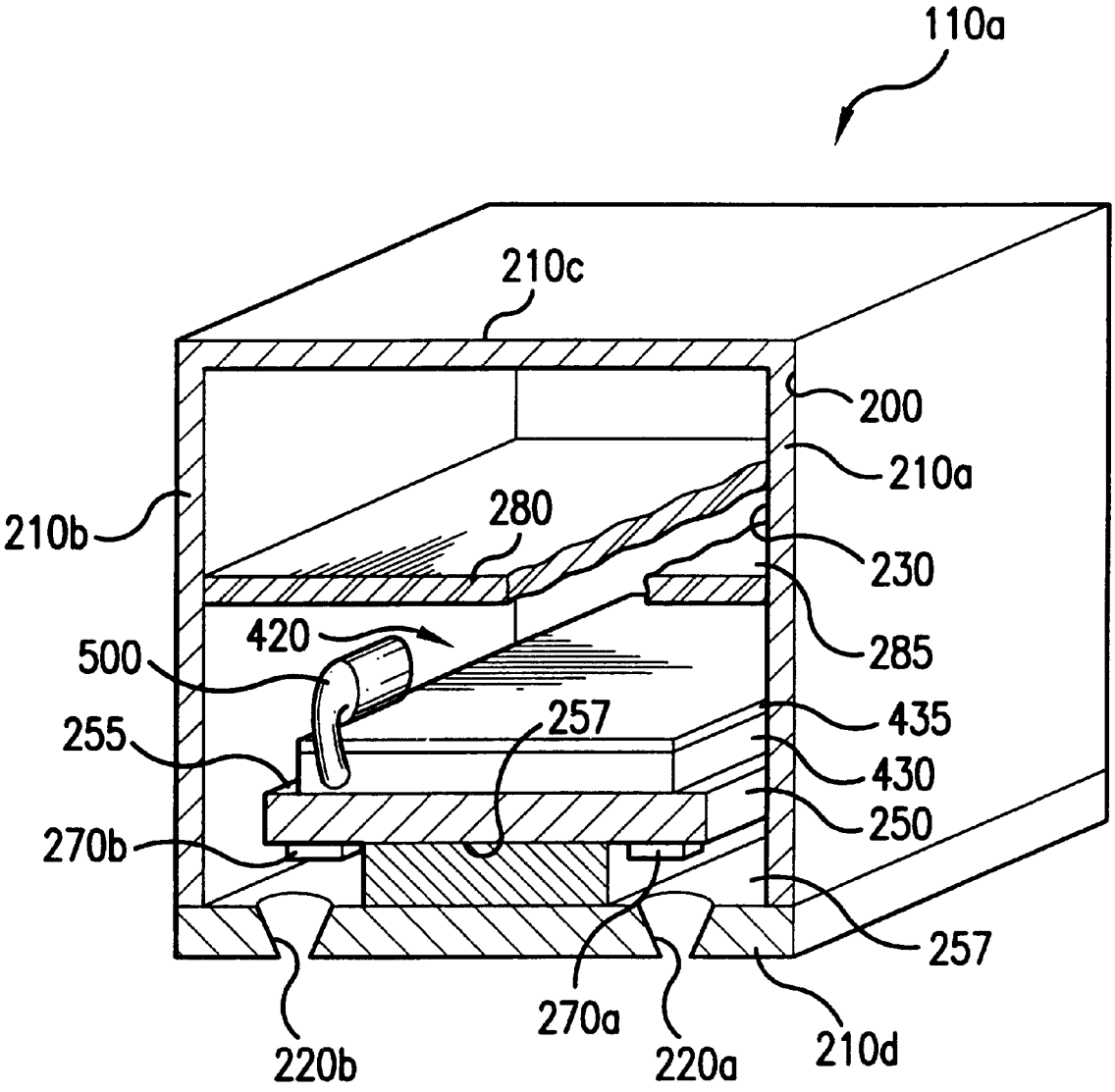
FIG. 16 is a perspective view in partial elevation of a tenth embodiment of a representative one of the cartridges.
Figure 17:
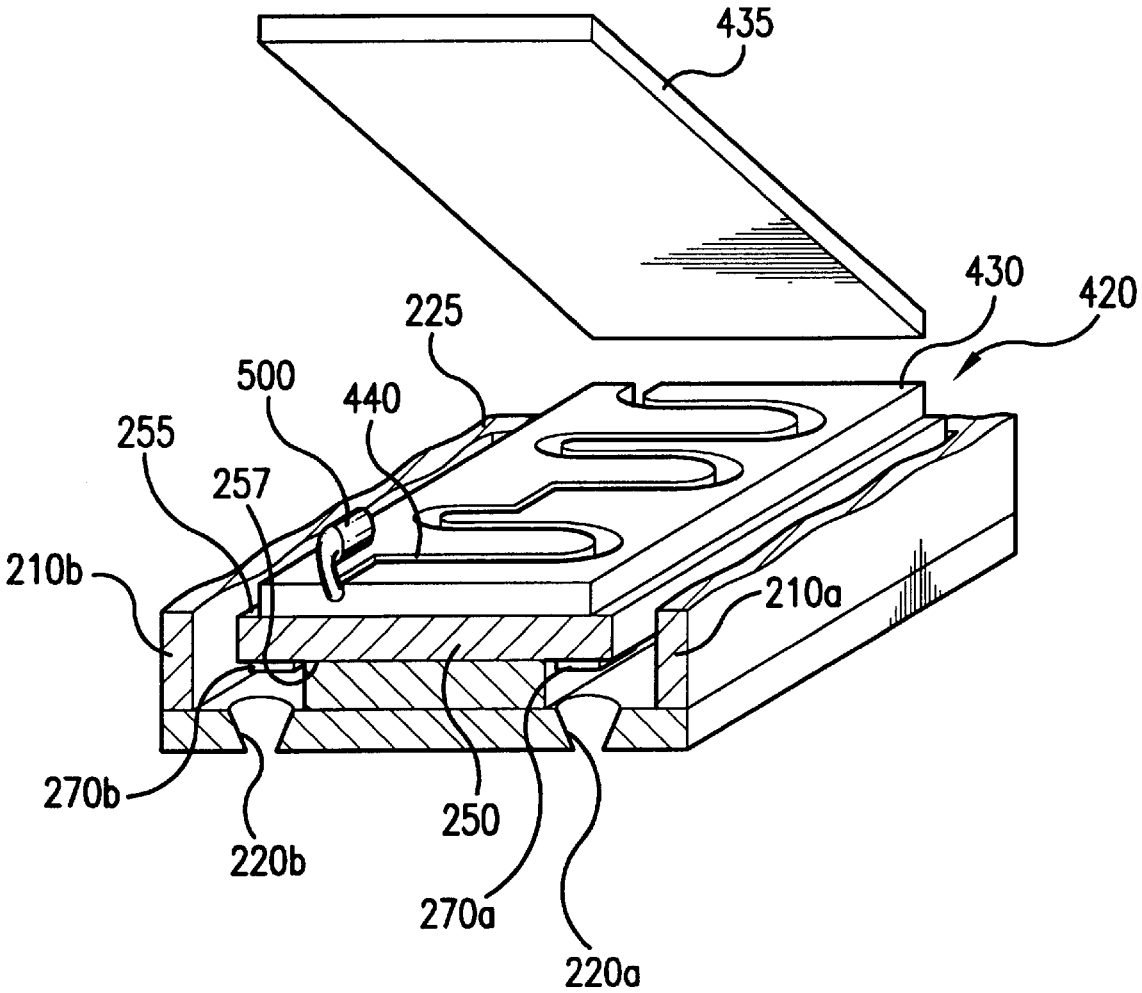
FIG. 17 is an exploded perspective view in partial elevation, and with parts removed for clarity, of the tenth embodiment of the cartridge.

Referring to FIGS. 16 and 17, a representative one of an tenth embodiment of ink cartridges 110*a/b/c/d* is there shown. This tenth embodiment ink cartridge, such as ink cartridge 110*a*, is similar to the ninth embodiment ink cartridge, except internal micro-pump assembly 450 is absent. Rather, a pump 500 external to radiator block 430 and connected to outlet 447 pumps ink through ink flow channel 440 for removing heat from substrate 250. The heat removed from substrate 250 is delivered by pump 500 to ink body 240. Alternatively, serpentine-shaped ink flow channel 440 may be etched into the backside of substrate 250, thereby eliminating need for radiator assembly 430 and requiring only cover 435 and pump 500.

Figure 18:
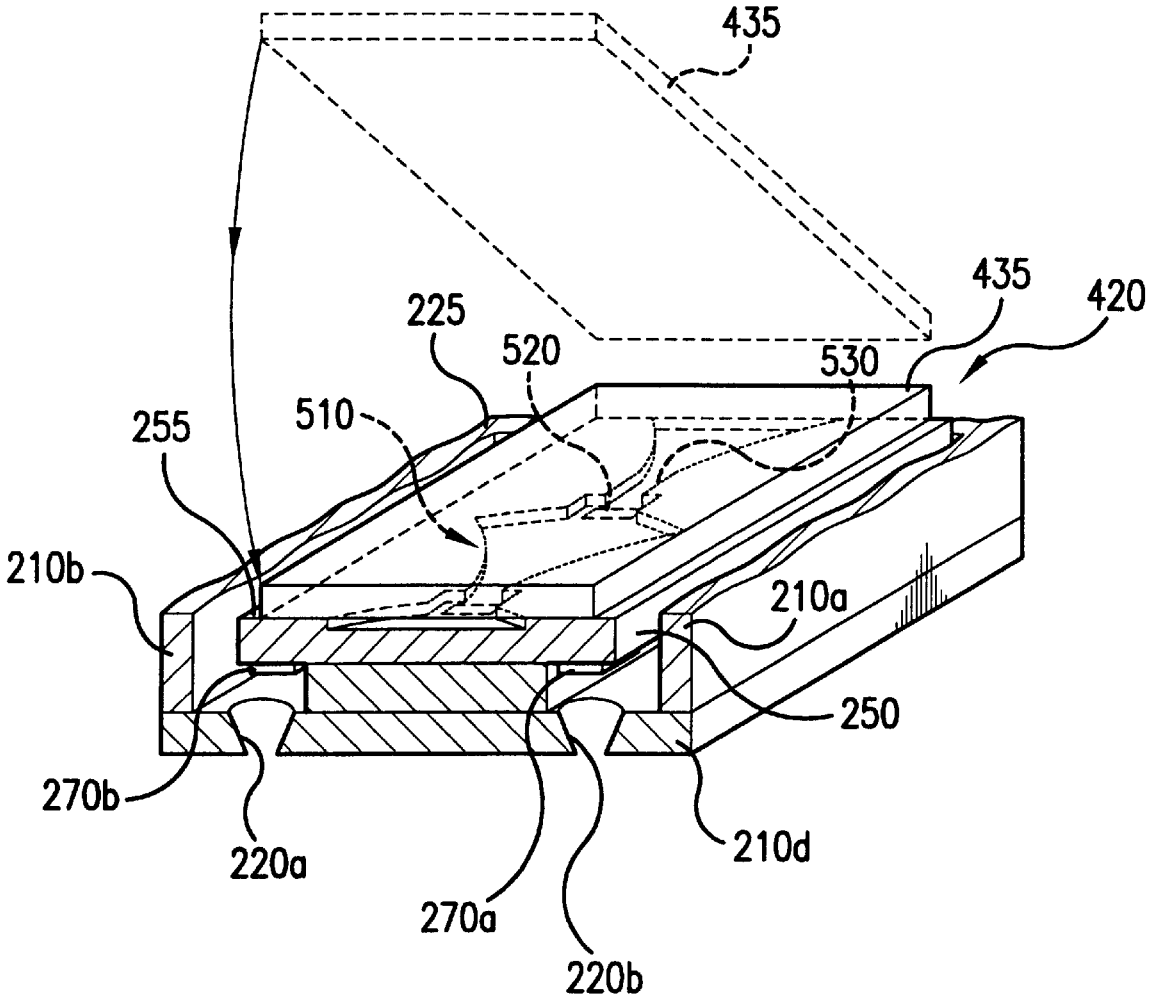
FIG. 18 is an exploded perspective view in partial elevation, and with parts removed for clarity, of an eleventh embodiment of a representative one of the cartridges.
Figure 19:
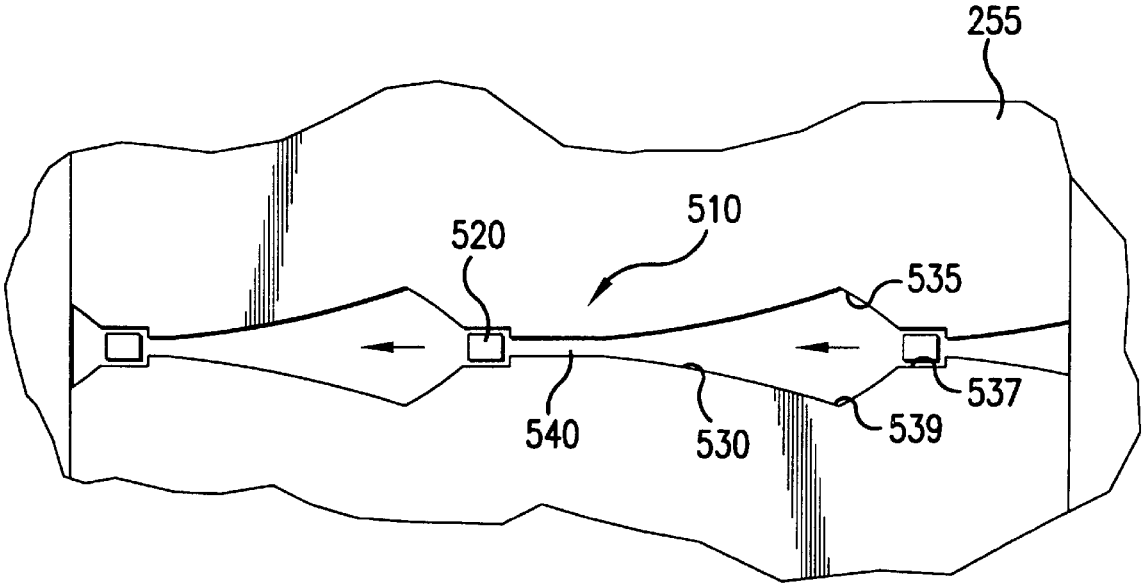
FIG. 19 is a fragmentation view of the eleventh embodiment of the cartridge.

Referring to FIGS. 18 and 19, a representative one of an eleventh embodiment of ink cartridges 110*a/b/c/d* is there shown. This eleventh embodiment ink cartridge, such as ink cartridge 110*a*, is similar to the ninth embodiment ink cartridge, except radiator block 430 is absent and first embodiment micro-pump assembly 450 is replaced by a second embodiment micro-pump assembly, generally referred as 510. Second embodiment micro-pump assembly 510 comprises a plurality of spaced-apart thermal resistors 520 disposed in a flow channel or groove 530 formed in top surface 255 of substrate 250. Groove 530 extends longitudinally along substrate 250 and includes a plurality of interconnected cells 535 each including an alcove 537 for receiving resistor 520. Each cell 535 further includes a widened portion 539 tapering into a narrowed portion 540. Resistors 520 move ink through groove 530 by timed firing pulses and the mechanism commonly referred to in the art as differential refill. Alternatively, piezoelectric members, rather than resistors 520, may be used if desired.

Figure 20:
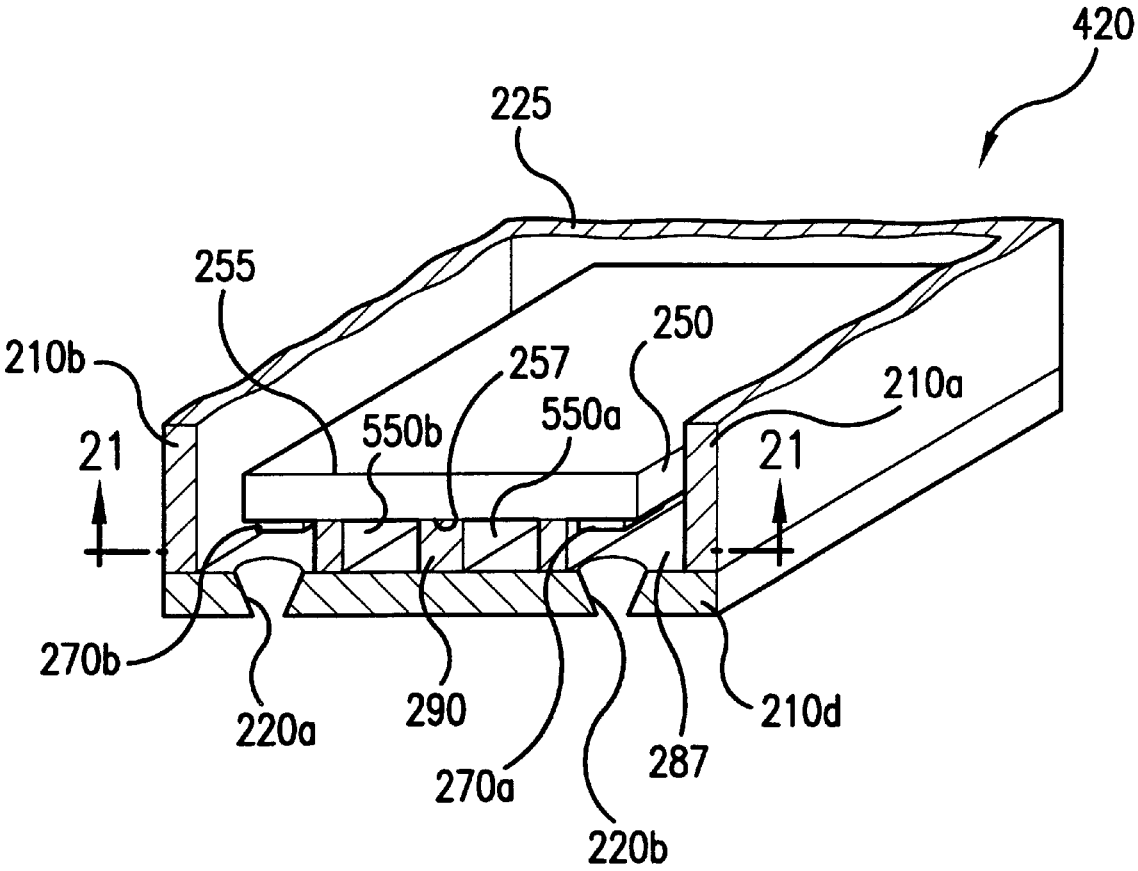
FIG. 20 is an exploded perspective view in partial elevation, and with parts removed for clarity, of a twelfth embodiment of a representative one of the cartridges.
Figure 21:
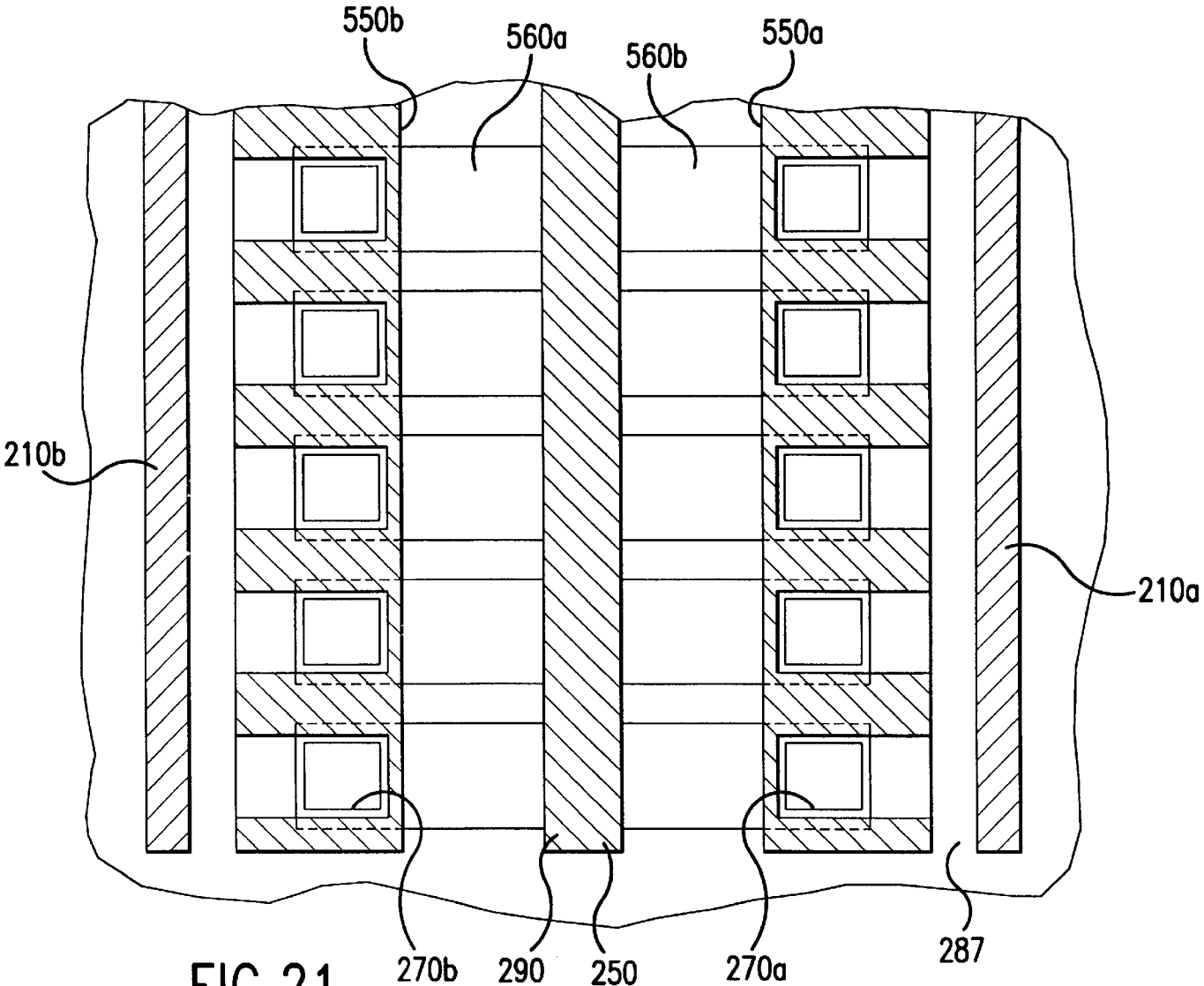
FIG. 21 is a fragmentation view of the twelfth embodiment of the cartridge.
Figure 22:
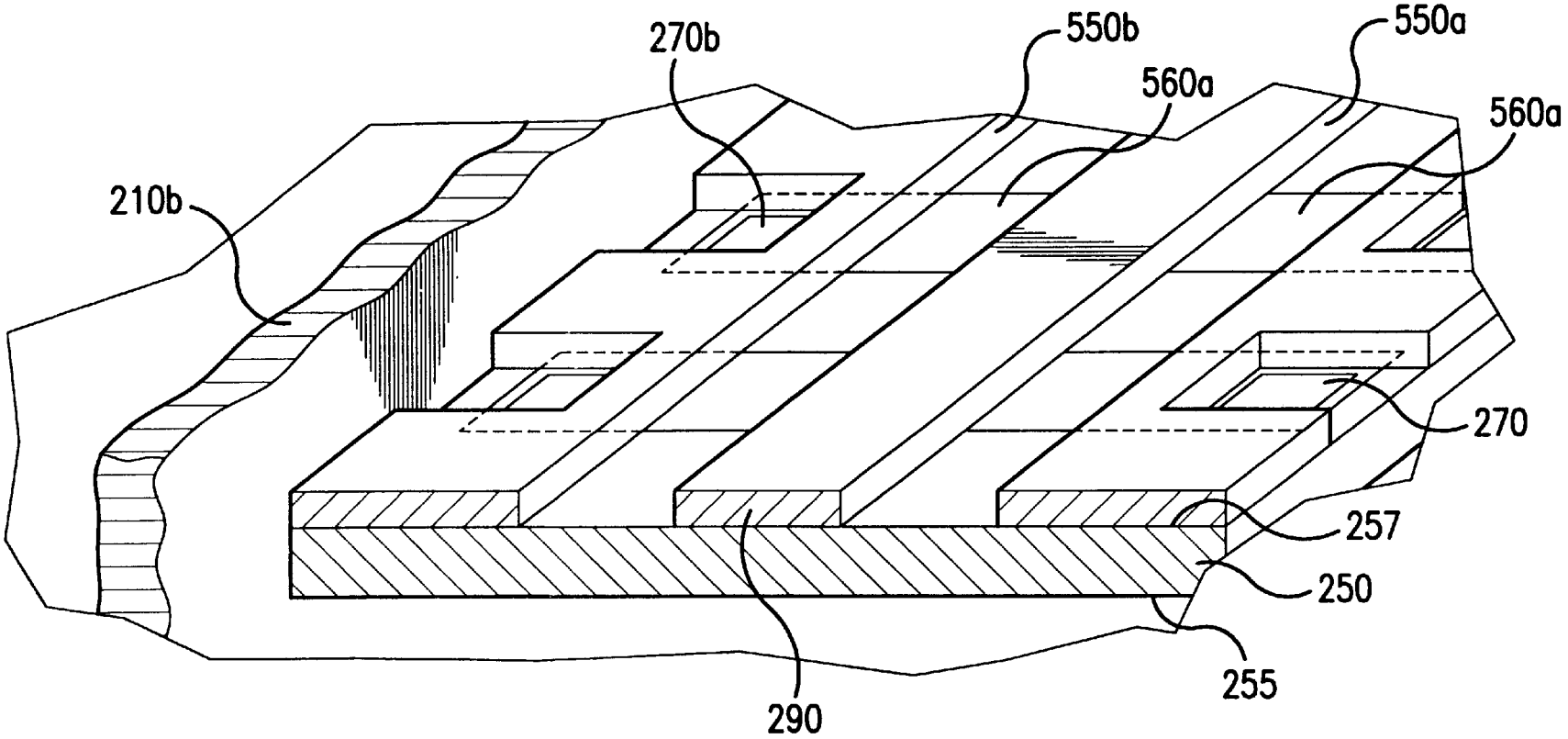
FIG. 22 is a fragmentation view in perspective of the twelfth embodiment of the cartridge.

Referring to FIGS. 20, 21 and 22, a representative one of a twelfth embodiment of ink cartridges 110*a/b/c/d* is there shown. This twelfth embodiment ink cartridge, such as ink cartridge 110*a*, is similar to the eighth embodiment ink cartridge, except heat removal structure 290 includes a plurality of parallel ink flow channels, such as first canals 550*a* and second canals 550*b*, running longitudinally in base 265 (or similarly septum 370). A conductor bridge 560*a* interconnects resistor 270*a* with its associated canal 550*a* (as shown). Also, a conductor bridge 560*b* interconnects resistor 270*b* with it associated canal 550*b* (as shown). Heat generated by resistors 270*a/b* is conducted by means of heat conductor bridges 560*a/b* into canals 550*a/b*. Ink flowing along first canal 550*a* and second canal 550*b* comes into contact with heat conductor bridges 560*a/b*, so that heat conductor bridge 560*a/b* picks-up the heat generated by resistors 270*a* and 270*b* and delivers that heat to the ink in canals 550*a/b*. In this manner, the heat is delivered to ink body 240.

It may be appreciated from the description hereinabove, that an advantage of the present invention is that printing speed is increased. This is so because transfer of heat from the print head is enhanced, thereby allowing for increased resistor firing frequency. Increased resistor firing frequency allows increased printing speed.

Another advantage of the present invention is that use thereof allows for proper bubble formation (e.g., size of vapor bubble). This is so because excessive heat generation is ameliorated by enhanced heat removal.

Still another advantage of the present invention is that risk of premature ejection of ink drops is reduced. This is so because excessive heat generation may cause the ink drop to be prematurely ejected and the present invention removes excessive heat.

Yet another advantage of the present invention is that risk of accumulation of unintended vapor bubbles in the ink is reduced. Accumulation of unintended vapor bubbles is caused by excessive heat generation and use of the present invention reduces excessive heat generation.

Moreover, another advantage of the present invention is that use thereof prolongs operational lifetime of the resistance heater. This is so because excessive heat generation damages the resistance heater over time and use of the present invention reduces excessive heat generation.

While the invention has been described with particular reference to its preferred embodiments, it will be understood by those skilled in the art that various changes may be made and equivalents may be substituted for elements of the preferred embodiments without departing from the invention. For example, acoustic sound waves may be introduced into the firing chamber region for agitating the ink body to produce eddy currents in the ink body. Production of eddy currents in the ink body will tend to disperse the heat throughout the ink body. Dispersal of heat throughout the ink body enhances removal of heat from the vicinity of the thermal resistors.

Therefore, what is provided is a thermal ink jet printer having enhanced heat removal capability and method of assembling the printer, the printer being adapted for high speed printing and increased thermal resistor lifetime.

Parts List

10 . . . thermal inkjet printer
20 . . . image
30 . . . recording medium
40 . . . housing
45 . . . first opening
47 . . . second opening
50 . . . frame
55 . . . aperture
60 . . . first motor
70 . . . spindle
80 . . . rollers
90 . . . slide bar
100 . . . ink cartridge holder
110*a/b/c/d* . . . ink cartridges
120 . . . belt drive assembly
130*a/b* . . . rollers
140 . . . second motor
150 . . . belt
160 . . . controller
170*a/b* . . . electricity flow paths (wires)
180 . . . ink drop
190 . . . supply tray
200 . . . cartridge shell
210*a* . . . first sidewall
210*b* . . . second sidewall
210*c* . . . top wall
210*d* . . . nozzle plate
220*a/b* . . . nozzles orifices
225 . . . rear wall
230 . . . chamber
240 . . . ink body
250 . . . substrate
255 . . . top surface
257 . . . bottom surface
260 . . . vapor bubble
265 . . . base
270*a* . . . first resistors
270*b* . . . second resistors
280 . . . filter
285 . . . ink reservoir region
287 . . . firing chamber region
290 . . . heat removal structure
300 . . . cooling chamber
305 . . . coolant
310 . . . protuberance
320 . . . fins
325 . . . grooves
330 . . . first embodiment agitator
335 . . . propeller motor
340 . . . propeller
350 . . . second embodiment agitator
360 . . . membrane
365 . . . piston member
367 . . . piston actuator
368 . . . arrow
370 . . . septum
375*a* . . . first recess
375*b* . . . second recess
380*a* . . . first ink flow channel
380*b* . . . second ink flow channel
410*a* . . . first barrier block
410*b* . . . second barrier block
412*a* . . . first tunnel
412*b* . . . second tunnel
415*a/b* . . . arrows
420 . . . first embodiment radiator assembly
430 . . . radiator block
435 . . . cover
440 . . . ink flow channel
445 . . . inlet
447 . . . outlet
450 . . . first embodiment micro-pump assembly
460 . . . wheel
470 . . . axle
480 . . . spokes
490 . . . electromagnets
495 . . . electrical contacts
497 . . . arrow
500 . . . external pump
510 . . . second embodiment micro-pump assembly
520 . . . thermal resistors
530 . . . groove
535 . . . cells
537 . . . alcove
539 . . . widened portion
540 . . . narrowed portion
550*a* . . . first canal
500*b* . . . second canal
560*a* . . . first conductor bridge
560*b* . . . second conductor bridge

What is claimed is:

1. A thermal inkjet printer having enhanced heat removal capability, comprising:

a. a thermal inkjet print head adapted to hold an ink body, said print head including:

i. a heating element adapted to be in fluid communication with the ink body;

ii. a heat removal structure in thermal communication with said heating element for transferring heat from said heating element to the ink body; and b. a controller coupled to said heating element.

2. The printer of claim 1, wherein said heat removal structure is porous.

3. The printer of claim 1, wherein said heat removal structure defines a cooling chamber therein for receiving a coolant.

4. The printer of claim 3, wherein said heat removal structure forms a protuberance filled with the coolant and in thermal communication with the ink chamber.

5. The printer of claim 1, wherein said heat removal structure comprises a fin.

6. The printer of claim 1, wherein said heat removal structure comprises an agitator.

7. The printer of claim 1, wherein said heat removal structure defines a coolant flow channel therein.

8. The printer of claim 7, wherein said heat removal structure comprises a pump coupled to the flow channel.

9. The printer of claim 7, wherein said heat removal structure comprises a heat conductor bridge interconnecting said heating element and said flow channel.

10. A thermal inkjet printer having enhanced heat removal capability, comprising:

a. a thermal inkjet print head adapted to hold an ink body therein, said print head including:

i. an resistive heating element adapted to be in fluid communication with the ink body for generating heat to heat the ink body, so that a vapor bubble forms in the ink body;

ii. a heat removal structure in thermal communication with said heating element and in fluid communication with the ink body for transferring the heat from said heating element to the ink body; and b. a controller coupled to said heating element for controllably supplying a plurality of electrical pulses to said heating element for electrically energizing said heating element.

11. The printer of claim 10, wherein said heat removal structure comprises:

a. a thermally conductive support member coupled to said heating element for supporting said heating element and for conducting the heat from said heating element and through said support member; and b. a thermally conductive heat sink coupled to said support member and in fluid communication with the ink body for transferring the heat from the support member and to the ink body.

12. The printer of claim 11, wherein said heat sink is porous for filtering the ink body.

13. The printer of claim 11, wherein said heat sink comprises an enclosure defining a cooling chamber for enclosing a thermally conductive coolant therein.

14. The printer of claim 13, wherein said enclosure forms a protuberance projecting into the ink body for increasing heat transfer surface area of said enclosure, the protuberance forming a cavity therein in thermal communication with the chamber, the cavity being adapted to receive the coolant.

15. The printer of claim 10, wherein said heat removal structure comprises a cooling fin integrally formed therewith for increasing heat transfer surface area of said heat removal structure.

16. The printer of claim 10, wherein said heat removal structure comprises an agitator in fluid communication with the ink body for agitating the ink body, so that the heat disperses throughout the ink body.

17. The printer of claim 16, wherein said agitator comprises a rotatable propeller.

18. The printer of claim 16, wherein said agitator comprises an oscillatable membrane.

19. The printer of claim 10, wherein said heat removal structure defines a coolant flow channel therein for passage of a coolant therealong.

20. The printer of claim 19, wherein said heat removal structure comprises a pump coupled to the flow channel for pumping the coolant along the flow channel.

21. The printer of claim 20, wherein said pump comprises a piezoelectric member capable of flexing in response to a plurality of timed electrical pulses transmitted to said piezoelectric member.

22. The printer of claim 20, wherein said pump comprises a thermal resistor unit capable of heating the coolant in response to a plurality of timed electrical pulses transmitted to said thermal resistor unit.

23. The printer of claim 19, wherein said heat removal structure comprises a heat conductor bridge interconnecting said heating element and the flow channel for transferring heat from said heating element and to the flow channel.

24. A thermal inkjet print head having enhanced heat removal capability, comprising:

a. an ink jet cartridge shell adapted to hold an ink body;

b. a heating element disposed in said ink cartridge shell and adapted to be in fluid communication with the ink body, and c. a heat removal structure in thermal communication with said heating element for transferring heat from said heating element and to the ink body.

25. The print head of claim 24, wherein said heat removal structure is porous.

26. The print head of claim 24, wherein said heat removal structure defines a cooling chamber therein for receiving a coolant.

27. The print head of claim 26, wherein said heat removal structure forms a protuberance filled with the coolant and in thermal communication with the chamber.

28. The print head of claim 24, wherein said heat removal structure comprises a fin.

29. The print head of claim 24, wherein said heat removal structure comprises an agitator.

30. The print head of claim 24, wherein said heat removal structure defines a coolant flow channel therein.

31. The print head of claim 30, wherein said heat removal structure comprises a pump coupled to the flow channel.

32. The print head of claim 30, wherein said heat removal structure comprises a heat conductor bridge interconnecting said heating element and the flow channel.

33. A method of assembling a thermal inkjet printer having enhanced heat removal capability, comprising the steps of:

a. providing a heating element adapted to be in fluid communication with an ink body;

b. arranging a heat removal structure so as to be in thermal communication with the heating element for transferring heat from the heating element to the ink body; and c. coupling a controller to the heating element.

34. The method of claim 33, wherein the step of arranging the heat removal structure comprises the step of arranging a heat removal structure that is porous.

35. The method of claim 33, further comprising the step of forming a cooling chamber in the heat removal structure for receiving a coolant.

36. The method of claim 35, further comprising the step of forming a protuberance outwardly projecting from the heat removal structure and having a hollow interior in thermal communication with the chamber, the protuberance adapted to be filled with the coolant.

37. The method of claim 33, further comprising the step of forming a fin on a surface of the heat removal structure.

38. The method of claim 33, further comprising the step of coupling an agitator to the heat removal structure.

39. The method of claim 33, further comprising the step of forming a coolant flow channel in the heat removal structure.

40. The method of claim 39, further comprising the step of coupling a pump to the flow channel.

41. The method of claim 39, further comprising the step of interconnecting a heat conductor bridge to the heating element and the flow channel.

42. A method of assembling a thermal inkjet print head having enhanced heat removal capability, comprising the steps of:

a. providing an ink cartridge shell adapted to hold an ink body;

b. disposing a heating element in the ink cartridge shell, the heating element adapted to be in fluid communication with the ink body; and c. arranging a heat removal structure in thermal communication with the heating element for transferring heat from the heating element to the ink body.

43. The method of claim 42, wherein the heat removal structure is porous.

44. The method of claim 42, further comprising the step of forming a cooling chamber in the heat removal structure for receiving a coolant.

45. The method of claim 44, further comprising the step of forming a protuberance outwardly projecting from the heat removal structure and having a hollow interior in thermal communication with the chamber, the protuberance adapted to be filled with the coolant.

46. The method of claim 42, further comprising the step of forming a fin on a surface of the heat removal structure.

47. The method of claim 42, further comprising the step of coupling an agitator to the heat removal structure.

48. The method of claim 42, further comprising the step of forming a coolant flow channel in the heat removal structure.

49. The method of claim 48, further comprising the step of coupling a pump to the flow channel.

50. The method of claim 48, further comprising the step of interconnecting a heat conductor bridge to the heating element and the flow channel.

* * * * *